US006050750A

United States Patent [19]

Aoki

[11] Patent Number: 6,050,750

[45] **Date of Patent: *Apr. 18, 2000**

[54] FLEXIBLE CONTAINER, METHOD AND APPARATUS FOR TRANSMITTING A PARTICULATE MATERIAL FROM THE FLEXIBLE CONTAINER, AND DISCHARGE UNIT FOR THE FLEXIBLE CONTAINER

[75] Inventor: Shuji Aoki, Nishinomiya, Japan

[73] Assignee: Toyo Hitec Kabushiki Kaisha, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/827,759

[22] Filed: Apr. 10, 1997

[30] Foreign Application Priority Data

Jul. 1, 1996 [JP] Japan ..... 8-191462

[51] Int. Cl.[7] ..... B65G 53/10

[52] U.S. Cl. ..... 406/145; 406/143; 406/146; 406/151

[58] Field of Search ..... 406/92, 93, 137, 406/143, 145, 146, 151, 152, 153, 173, 175

[56] References Cited

U.S. PATENT DOCUMENTS 3,063,755 11/1962 Wijdeveld et al. ..... 406/93
5,474,111 12/1995 Williamson et al. ..... 406/137 X

FOREIGN PATENT DOCUMENTS 282355 9/1990 Germany ..... 406/153

*Primary Examiner*—Christopher P. Ellis
*Assistant Examiner*—Jeffrey A. Shapiro
*Attorney, Agent, or Firm*—Ronald E. Greigg; Edwin E. Greigg

[57] ABSTRACT

A flexible container for a particulate material includes a main body having a sealable input opening in an upper portion thereof, and a sleeve extending from a lower portion of the main body. A connector is connected to a distal end which is folded along a side of the sleeve for storage. In carrying out a method of removing and transmitting the particulate material to another destination, the connector is connected to a carrier gas control device which supplies a carrier gas to the container that is mixed with the particulate material then the device has a transmitting pipe which transmits the particulate material to a container in a distant place. A suction is provided by the container in order to draw the particulate material to the container.

19 Claims, 12 Drawing Sheets

FLEXIBLE CONTAINER, METHOD AND APPARATUS FOR TRANSMITTING A PARTICULATE MATERIAL FROM THE FLEXIBLE CONTAINER, AND DISCHARGE UNIT FOR THE FLEXIBLE CONTAINER

BACKGROUND OF THE INVENTION

1. Field of the Invention

This invention relates to a flexible container for use in storage and transmission of a particulate material, a method of transmitting the particulate material from the flexible container by removing the particulate material out of the flexible container and transmitting the particulate material to a desired destination, an apparatus for executing this method in transmitting the particulate material from the flexible container, and a discharge unit for the flexible container which is used with this apparatus. More particularly, the invention relates to a flexible container, a method and apparatus for transmitting a particulate material from the flexible container, and a discharge unit for the flexible container, which enables transmission over a long distance or to a high location without scattering the particulate material to the ambient, and moreover, allow for low costs of the receiving equipment while avoiding an increase in volume and weight of the flexible container.

2. Description of the Prior Art

It is conventional practive, at a factory or the like handling a particulate material, to open bags containing stock powder and allow the powder to fall into a receiving hopper or a hopper of a processing apparatus in a first stage. This operation to fill the hopper, with the harmful particles of stock powder scattering to the ambient, is a hard, dirty and dangerous operation which pleases no worker. To avoid such scattering of stock powder to the ambient, a flexible container 100 as shown in FIG. 10, for example, is used as a container for transmitting stock powder today.

This flexible container 100 includes a main body 101 having a sealable input opening 102 formed in an upper portion thereof, and a discharge section 103 continuous from the lower end of the main body 101. This discharge section 103 is tied and sealed in an intermediate position thereof with a string 104 or the like. Then the discharge section 103 is turned up and bound with another string 105. In this state, a particulate material is introduced through the input opening 102, and thereafter the input opening 102 is sealed to be ready for storage or transportation.

At a receiving location, the string 105 binding the upturned discharge section 103 is unfastened and, as shown in FIG. 11, the lower end of the discharge section 103 is inserted into an input opening of a receiving hopper 107 of a particulate material transmitting apparatus 106. Alternatively, as shown in or FIG. 12, the lower end of discharge section 103 may be fitted over the input opening of the receiving hopper 107 and fastened thereto in a sealed condition. Subsequently, the string 104 closing the intermediate position of discharge section 103 is unfastened, and the stock powder in the flexible container 100 is allowed to fall into the receiving hopper 107. The stock powder is transmitted from a discharge unit 108 communicating with the lower end of receiving hopper 107, through a transmitting pipe 110 to a predetermined destination.

The particulate material transmitting apparatus 106 includes the receiving hopper 107, the discharge unit 108 connected to the lower end of the receiving hopper 107, a pressurized fluid source 109 for mixing a fluid under pressure into the particulate material in the receiving hopper 107 through the discharge unit 108, and the transmitting pipe 110 which receives, through the discharge unit 108, the particulate material having increased fluidity with the pressurized fluid mixed therein. A collecting device 111 is provided at the destination as necessary for collecting the particulate material separated from the pressurized fluid The particulate material collected in the collecting device is dropped into a receiving hopper of a particulate material transmitting apparatus in a second stage. The particulate material is transmitted from this receiving hopper to a collecting device of the particulate material transmitting apparatus in this stage. Then, the material is dropped into a relay hopper of a particulate material transmitting apparatus in a next stage or into the processing apparatus in the first stage.

However, the above method requires the receiving hopper 107 for receiving stock powder from the flexible container 100, which gives rise to a problem of increased cost of equipment at the receiving location.

In the conventional particulate material transmitting apparatus 106, the discharge section 103 comes off the receiving hopper 107 easily under increased transmitting pressure, and therefore the transmitting pressure cannot be raised above a certain fixed level. Consequently, the transmitting distance can be set to 10 meters at most, and the transmitting lift to 2 to 3 meters at most. The particulate material transmitting apparatus 106 must be installed in two to three stages between the receiving hopper 107 and the processing apparatus in the first stage which have a horizontal distance of 15 to 30 meters and a level difference of several meters to ten odd meters therebetween. This further increases the cost of equipment at the receiving location.

As a further problem, when the particulate material falls from the flexible container 100, with the lower end of discharge section 103 inserted into the input opening of receiving hopper 107 as shown in FIG. 11, fine particles fly from between the receiving hopper 107 and the input opening of discharge section 103 to scatter to the ambient.

Where, as shown in FIG. 12, the lower end of the discharge section 103 of flexible container 100 is bound to the outer peripheral surface of the input opening of receiving hopper 107, the particulate material becomes lodged between the lower end of flexible container 100 and the input opening of receiving hopper 107. This gives rise to a problem that this particulate material scatters to the ambient when the flexible container 100 is removed from the receiving hopper 107 after a material dropping operation.

In addition, the peripheral edge of the opening in the lower end of flexible container 100 is simply tied to the receiving hopper according to this method. Therefore, with an increase in the transmitting pressure of the particulate material transmitting apparatus 106, the flexible container 100 becomes loose from the receiving hopper 107, whereby the stock powder in the flexible container 100 scatters to the ambient.

To solve this problem, a special flexible container has been marketed in recent years. In place of the discharge section, a tub-like palette formed of a synthetic resin is connected to the lower end of the main body of the flexible container. A pressurized fluid is introduced under pressure into the main body through this palette to increase the fluidity of the particulate material. The particulate material is taken out of the main body by causing it to fall to a discharge gate provided on a lateral surface of the palette, or by blowing it up through an exhaust opening formed at the upper end of the main body (Semi-Bulk Systems, Missouri, U.S.A.; product name: Air Palette System).

According to this special flexible container, the receiving hopper and the discharge unit of the particulate material transmitting apparatus may be omitted from the receiving location, which allows a reduction in the cost of equipment at the receiving location. Moreover, the discharge gate and/or exhaust opening can be sealed with a self-closing coupling, for example. Thus, a transmitting pipe can be connected and disconnected with little possibility of scattering fine particles to the ambient.

However, since this flexible container has the synthetic resin palette connected to a lower position thereof, a large space is occupied whether filled with a particulate material or in a tare state. This poses a problem of increasing storage and transmission costs.

The flexible container itself is expensive because of the palette provided for the bottom of the flexible container. Considering the cost of the flexible container itself, and the increased costs such as the storage cost and transmission cost, a problem may be found in its practicability.

SUMMARY OF THE INVENTION

Having regard to the state of the art noted above, an object of this invention is to provide a flexible container which enables prevention of a particulate material scattering to the ambient and simplification of receiving equipment, hardly increases storage or transmission cost or the cost of the flexible container itself, and yet realizes an increased transmitting distance and transmitting lift.

Another object of this invention is to provide a method of transmitting a particulate material from a flexible container which enables prevention of the particulate material scattering to the ambient and simplification of receiving equipment and reduction of the receiving equipment, reduces storage and transmission costs and the cost of the flexible container itself, and yet realizes an increased transmitting distance and transmitting lift.

A further object of this invention is to provide an apparatus for transmitting a particulate material from a flexible container, which can execute the above method according to this invention, for transmitting a particulate material from a flexible container which enables prevention of the particulate material scattering to the ambient and simplification of receiving equipment and reduction of the receiving equipment, reduces storage and transmission costs and the cost of th flexible container itself, and yet realizes an increased transmitting distance and transmitting lift.

A still further object of this invention is to provide a discharge unit for a flexible container, which, in use particularly with the above method and apparatus according to this invention, is connectable to the flexible container easily and simply, and yet has a simple and inexpensive construction.

To fulfill the above objects, a flexible container according to this invention comprises a main body having a sealable input opening in an upper portion thereof, and a sleeve extending from a lower portion of the main body, characterized in that a connector is formed at a distal end of the sleeve to be connected to a discharge unit of a particulate material transmitting apparatus in a sealed condition.

Thus, the sleeve of the flexible container may be connected to the discharge unit of the particulate material transmitting apparatus in a sealed condition in the same procedure as for the conventional flexible container having a discharge section or directly by means of a joint as described later. The particulate material is prevented from scattering to the ambient when connecting the flexible container and particulate material transmitting apparatus.

The discharge unit has a shorter circumferential edge than the input opening of the receiving hopper. Consequently, a reduced quantity of particulate material remains between the sleeve and discharge unit and in edge regions of the discharge unit during transmission. Almost no particulate material scatters to the ambient when the sleeve and discharge unit are separated. Depending on a mode of implementation, scattering to the ambient of the particulate material when the sleeve and discharge unit are separated may be completely eliminated.

Further, receiving equipment may be simplified by omitting the receiving hopper. The flexible container and discharge unit are directly connected, thereby to increase transmitting distance and/or transmitting lift. The number of particulate material transmitting apparatus installed may be reduced, which enables a substantial reduction in equipment cost at the receiving location.

In addition, the flexible container of this invention corresponds to the conventional flexible container having a sleeve with only a connector added to the distal end of the sleeve. Therefore, compared with the conventional flexible container having a sleeve, hardly any increase occurs in volume or in weight when the container is filled with the particulate material or in tare state. Storage cost and transmission cost may be kept low. The flexible container itself has a simple construction and may be implemented easily.

Next, this invention provides a technical means as set out below for a method of transmitting a particulate material from a flexible container, wherein a fluid supplied from a fluid source is introduced into the flexible container, the particulate material having fluidity increased in the flexible container by this fluid supply is discharged into a transmitting pipe connected to the flexible container to be transmitted to a predetermined destination.

This method uses the above flexible container of this invention. The particulate material is transmitted from the flexible container to the predetermined destination by the particulate material transmitting apparatus after the connector of the flexible container is connected to the discharge unit of the particulate material transmitting apparatus in a sealed condition.

In the method according to this invention, the connector of the flexible container is separated from the discharge unit of the particulate material transmitting apparatus after completion of transmission of the particulate material.

Thus, the sleeve of the flexible container may be connected to the discharge unit of the particulate material transmitting apparatus in a sealed condition in the same procedure as for the conventional flexible container having a discharge section or directly by means of a joint. The particulate material is prevented from scattering to the ambient when connecting the flexible container and particulate material transmitting apparatus.

The discharge unit has a shorter circumferential edge than the input opening of the receiving hopper. Consequently, a reduced quantity of particulate material remains between the sleeve and discharge unit and in edge regions of the discharge unit during transmission. Almost no particulate material scatters to the ambient when the sleeve and discharge unit are separated. Depending on a mode of implementation, scattering to the ambient of the particulate material when the sleeve and discharge unit are separated may be completely eliminated.

Further, the hopper may be omitted from receiving equipment for simplicity, which enables a reduction in equipment cost at the receiving location.

In addition, the flexible container of this invention has only a connector added to the distal end of the sleeve. Therefore, compared with the conventional flexible container having a sleeve, hardly any increase occurs in volume or in weight when the container is filled with the particulate material or in tare state. Storage cost and transmission cost may be kept low. The flexible container itself has a simple construction and may be implemented easily.

To fulfill the objects noted hereinbefore, an apparatus according to this invention comprises a discharge unit for connection to the connector of the flexible container according to this invention, a pressurized fluid source for supplying a fluid into the flexible container through this discharge unit, and a transmitting pipe for transmitting to a predetermined destination the particulate material having fluidity increased in the flexible container by this fluid supply and dispensed by the discharge unit.

Thus, after connecting the connector of the flexible container of this invention to the discharge unit of particulate material transmitting apparatus in a sealed condition, the fluid is supplied from the fluid source into the flexible container through the discharge unit. The particulate material has fluidity increased in the flexible container by this fluid supply, and the particulate material with increased fluidity is dispensed by the discharge unit and transmitted through the transmitting pipe to a predetermined destination.

The method of this invention may be executed by using the flexible container of this invention whose sleeve has at least the distal end and the connector formed at the tip end thereof foldable on a lateral surface of the connector. Consequently, the particulate material is prevented from scattering to the ambient during transmission, receiving equipment is simplified, the receiving equipment is diminished, storage and transmission costs are reduced, and the flexible container itself is made inexpensive, all realized in a harmonious way.

In the method of this invention and the apparatus of this invention, the gas used for producing gas flows may be air, nitrogen gas, helium gas, carbonic acid gas, or a mixture of gases selected from the above. Generally, air is used.

When the particulate material is easily oxidized, nitrogen, carbonic acid gas, helium gas or a mixture of gases selected from these may be used to prevent oxidation of the particulate material.

Further, in the method and apparatus of this invention, the suction means for drawing the gas from the collecting means and releasing it to the atmosphere may have an exhaust pipe connected to a blast pipe of the particulate material to be used as a closed circuit for recirculating the gas. In this case, the particulate material may be transmitted as entrained by an inert gas such as nitrogen gas. It is thereby possible to transmit the particulate material safely while avoiding a danger of fine particle explosion and quality degradation due to oxidation of the particulate material.

To fulfill the foregoing objects, a discharge unit according to this invention comprises a connected portion for connection to the connector of the flexible container of this invention, a supply pipe for communicating a fluid from a fluid supplying fluid source to an interior of the flexible container connected to this connected portion, and a discharge pipe for communicating the interior of the flexible container connected to this connected portion to a transmitting pipe.

According to the discharge unit of this invention, the above apparatus of this invention is constructed by connecting the fluid source to the supply pipe and connecting the transmitting pipe to the discharge pipe. After constructing he apparatus of this invention as above, the connected portion of the discharge unit of this invention is connected in a sealed condition and in communication with the connector of the sleeve folded on a lateral surface of the main body of the flexible container, with the end opening directed upward. After unfolding the sleeve to which the discharge unit of this invention is connected, the fluid is supplied from the fluid source to the supply pipe to cause the particulate material in the flexible container to flow into the transmitting pipe. In this way, the method of this invention is executed.

After discharging the particulate material from the flexible container, the fluid supply is stopped, and the sleeve to which the discharge unit of this invention is connected is folded on the lateral surface of the main body, with the end opening directed upward. Finally the discharge unit of this invention is separated from the sleeve. Thus, the particulate material is transmitted without scattering to the ambient.

The operation is completed with the flexible container in a decompressed state. When the discharge unit of this invention is separated, ambient air is drawn through the separated portion, thereby further reducing scattering of the particulate material.

Since the discharge unit of this invention has the connected portion for connection to the flexible container, the discharge unit may be connected easily and simply. The discharge unit of this invention has a simple construction including the connected portion, supply pipe and discharge pipe, and therefore, implemented easily and at low cost.

DESCRIPTION OF THE PREFERRED EMBODIMENT

Figure 1:
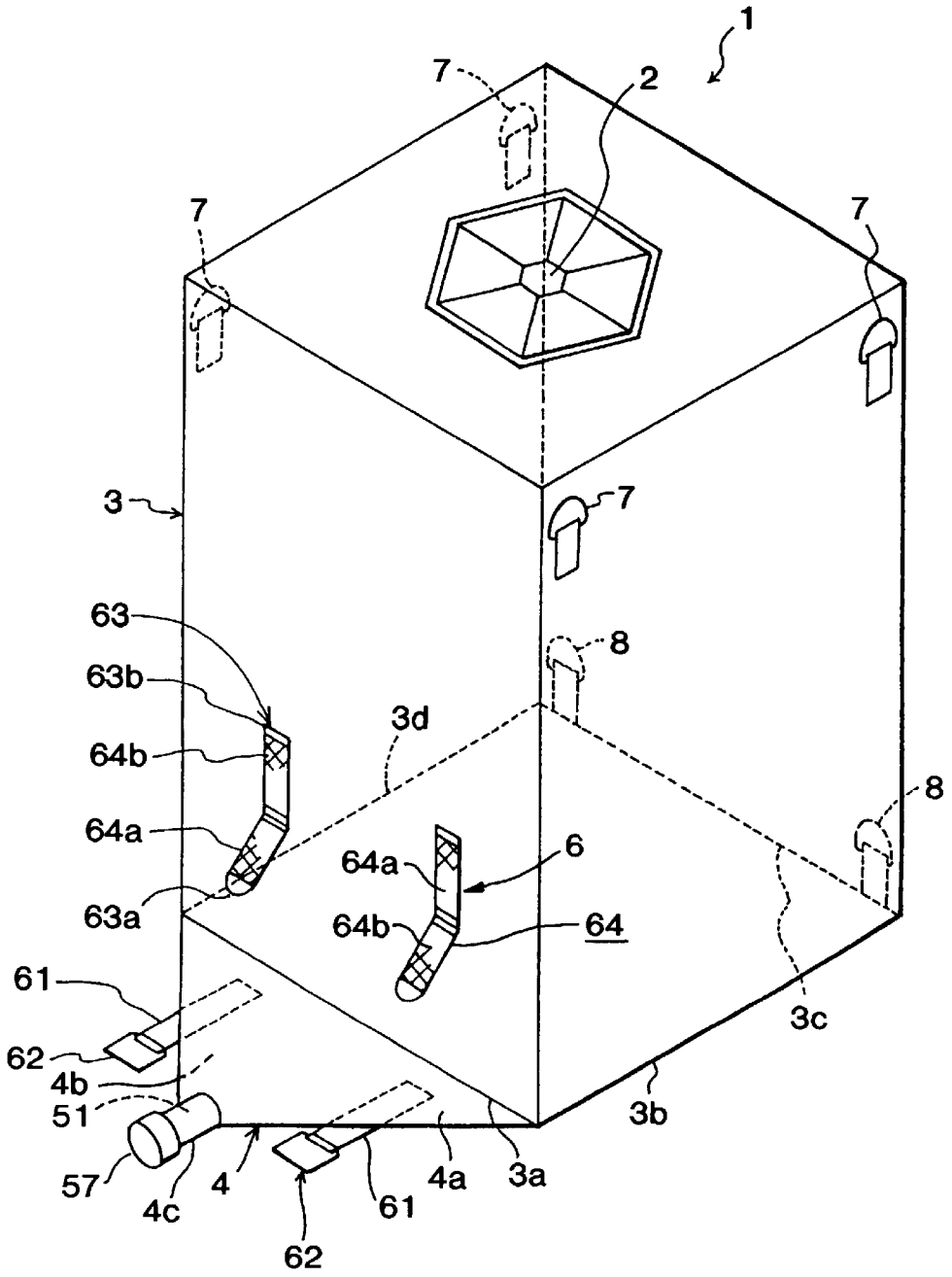
FIG. 1 is a perspective view of a flexible container in one embodiment of this invention.

A flexible container, a method and apparatus, and a discharge unit according to this invention will be described hereinafter with reference to the drawings. However, the flexible container, method, apparatus and discharge unit according to this invention are not limited by the following embodiments.

The flexible container of this invention will be described in detail hereinafter.

The main body of the flexible container of this invention essentially has the same construction as the main body of the conventional flexible container, and has a sealable input opening in an upper portion thereof for filling a particulate material into its interior. The main body also has suitable numbers of hooks and hook catches to be hung when introducing the particulate material, when handling the container as a load or when discharging the particulate material.

The main body is not limited to any particular shape, but generally is in the form of a bottomed or bottomless tube with a lid. This tube often has a circular, square or rectangular sectional shape.

The sleeve of the flexible container of this invention may have a leading edge continuous with an entire circumference of a lower edge of the main body, or continuous with part of the lower edge and part of a lateral surface of the main body, or may be continuous only with a lateral surface of a lower portion of the main body.

The shape of this sleeve, when opened, may be tapered such as a conical or pyramid-shaped taper, or may be tubular with a uniform section such as cylindrical or square tube-shaped. Its axis may be vertical and aligned or parallel to the axis of the main body, or may be horizontal and perpendicular to the axis of the main body or inclined downward relative to the axis of the main body.

In the flexible container of this invention, this sleeve is not limited to any particular shape. It is recommended that the sleeve of the main body is shaped such that at least the distal end and the connector formed on the distal end are foldable on a lateral surface of the main body, with an end opening of the connector directed upward.

The reason is that, when at least the distal end and the connector are folded on a lateral surface of the main body, with an end opening of the connector directed upward, the particulate material is reliably prevented from flowing through this sleeve and scattering to the ambient. By connecting or separating the discharged unit in this state, scattering to the ambient of the particulate material when connecting the discharge unit is completely avoided, and scattering to the ambient of the particulate material when separating the discharge unit is almost completely avoided.

Further, in the flexible container of this invention, where the sleeve of the main body is shaped such that at least the distal end and the connector formed on the distal end are foldable on a lateral surface of the main body, with an end opening of the connector directed upward, scattering to the ambient of the particulate material is avoided during storage and transportation, the discharge unit is attachable and detachable with ease, and operability and controllability of the attachment and detachment are promoted.

In this case, it is preferable that the main body includes means for holding at least the distal end and the connector as folded on the lateral surface of the main body, with the end opening of the connector directed upward. Then, the discharge unit may be connected and separated while the sleeve is folded on the lateral surface of the main body, with the end opening of the connector directed upward. Thus, the discharge unit may be connected to the sleeve with no particulate material scattering to the ambient. Besides, the discharge unit may be separated from the sleeve with almost no particulate material scattering to the ambient.

In the flexible container of this invention, the connector may be connectable in a sealed condition to the discharge unit of the particulate material transmitting apparatus. Connection in a sealed condition means here that a passage of a pressurized fluid and a passage of the particulate material are formed to be continuous through the connector connected and the discharge unit, and these passages are sealed off from ambient atmosphere.

Thus, the sleeve, as is the conventional discharge section, may be connected to the discharge unit by placing the distal end acting also as the connector on the discharge unit and binding an outer peripheral surface thereof tight. To promote operability and controllability of connection and separation, it is preferable that the discharge unit is connected through a joint. That is, in the flexible container of this invention, it is preferable that the connector has a male joint or a female joint corresponding to a female joint or a male joint provided for the discharge unit.

The joint may be a threaded joint, union joint or flange joint. In order to further promote operability and controlability of connection, it is preferable to use a quick joint such as a Machino quick joint or self-closing quick joint, or a lever type coupling joint which will be described later, which is connectable and separable by one-touch operation.

Preferably, the flexible container of this invention further comprises a lid for openably colosing the end opening of the connector. When the discharge unit is not connected to the connector, the end opening is closed by the lid thereby preventing entry of impurities and foreign matter to the flexible container.

The lid may, for example, be a cap fitted on or screwed to the distal end of the connector, a lid plate bolted to a flange or the like formed at the distal end of the connector, or a cover sewn for support to a lateral surface of the main body.

Figure 2:
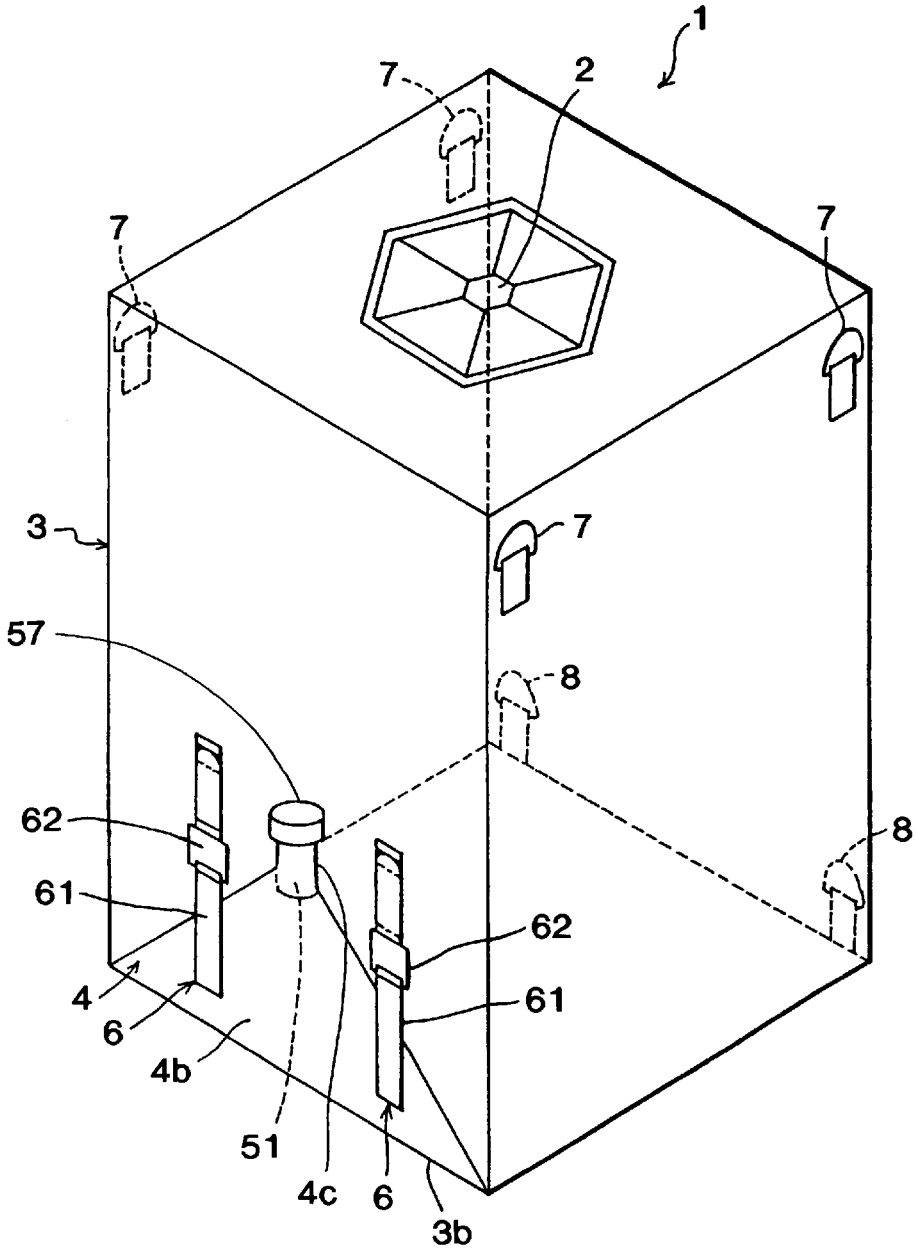
FIG. 2 is a perspective view showing a holding device for holding at least a distal end and a connector of a sleeve of the flexible container according to this invention, in a state of being folded on a lateral surface of a main body, with an opening of the connector opening upward.
Figure 3:
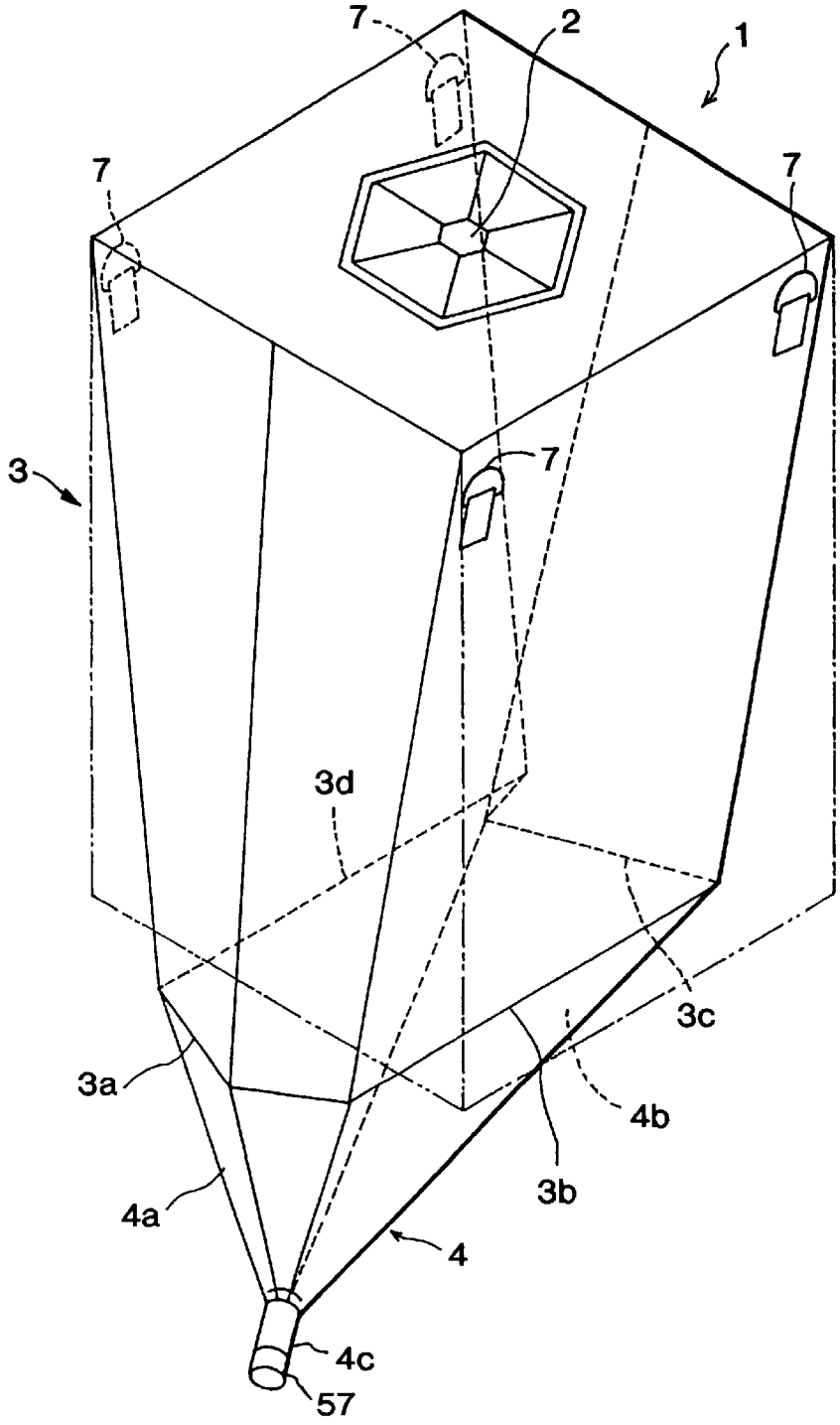
FIG. 3 is a perspective view of a flexible container of another embodiment of this invention.

As shown in FIGS. 1 through 3, a flexible container 1 in one embodiment of this invention includes a main body 3 having a sealable input opening 2 in an upper position thereof, a sleeve 4 extending from a lower position of the main body 3, and a holding device 6 for holding the distal end of the sleeve 4 as folded on one side surface of the main body 3.

Specifically, as shown in FIGS. 1 and 2, the main body 3 of this flexible container 1 is in the form of a bottomless square tube. The sleeve 4 includes one side surface 4*a* of approximately triangular shape continuous from one lower edge 3*a* of the main body 3, and an opposite surface 4*b* having an approximately triangular shape overlapping the one side surface 4*a* and continuous from a square formed by folding on the main body 3 and continuous from the remaining lower edges 3*b*–3*d* of the main body 3.

The distal end of the sleeve 4 formed of overlapping distal ends of one side surface 4*a* (FIG. 1) and opposite surface 4*b* (FIG. 2) is folded on the side surface 3*a* of the main body 3, with an end opening facing upward. The bottom plane of main body 3 is closed by this fold.

As shown in FIG. 3, the sleeve 4 assumes a tapered funnel shape, with an axis thereof extending downward, when opened after removing the sleeve from the connection to the holding device 6.

The sleeve 4 has a cylindrical connector 4*c* provided at the distal end thereof. The connector 4*c* is connected to a male connection 57 (which may be a female connection) of a lever type coupling joint 5 engageable and releasable by, as it were, one-touch operation (FIG. 5), in order to connect a discharge unit 11 of a particulate material transmitting apparatus 10 shown in FIG. 4.

Figure 5:
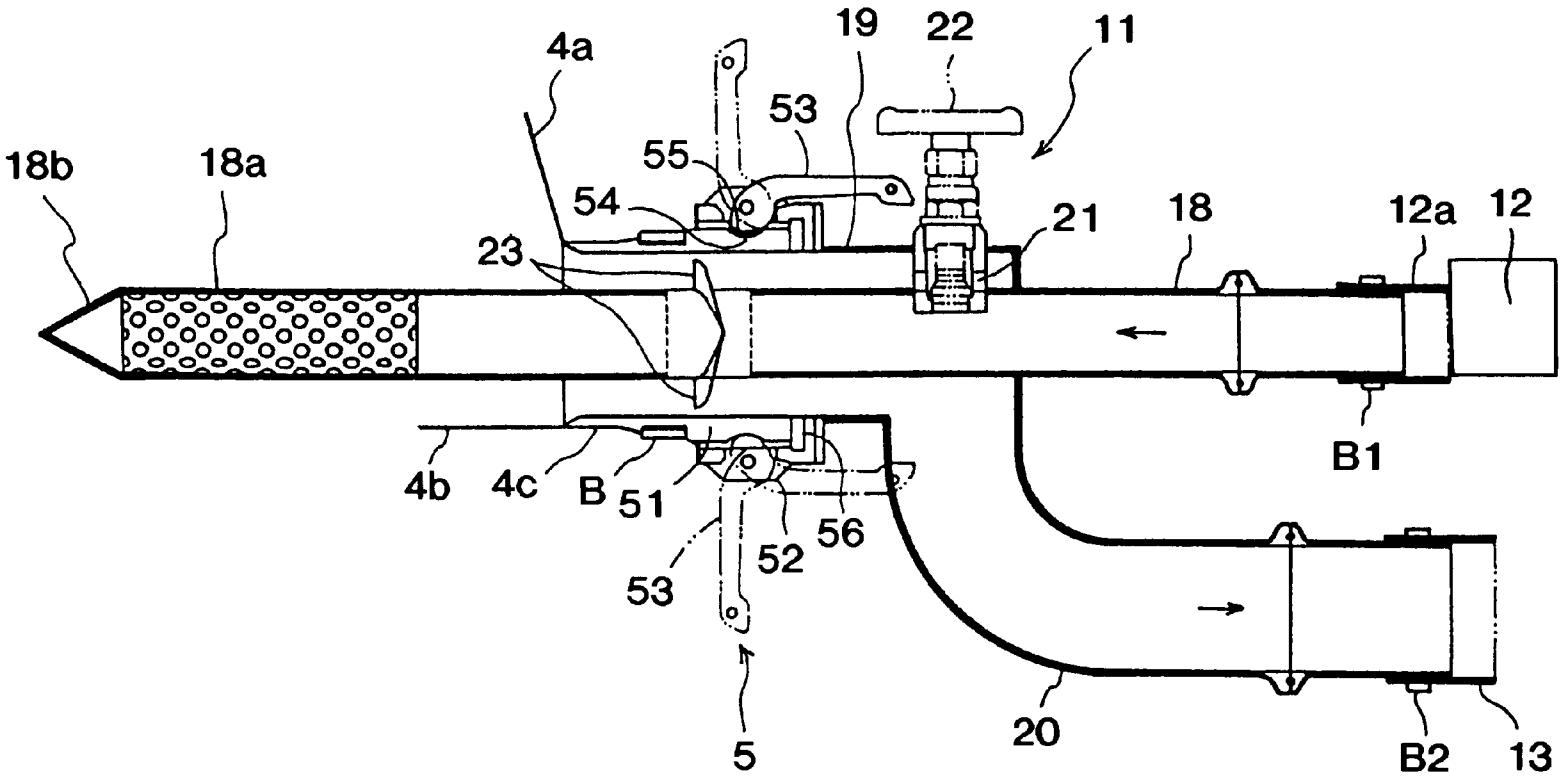
FIG. 5 is a sectional view of a unit in one embodiment of this invention.

That is, as shown in FIG. 5, a proximal end of this male joint 51 is inserted into an end opening of the connector 4*c*. The connector 4*c* is bound tight to an outer peripheral surface of the proximal end of the male joint 51 with a metal band B. Consequently, the male joint 51 is connected to the connector 4*c* of the sleeve 4 in communication and in a sealed condition therewith. The male joint 51 is positively prevented from slipping off the connector 4*c*.

Further, as shown in FIGS. 1 and 2, a cap 57 is removably attached to the connector 4*c* to close its opening when the sleeve 4 is not connected to the discharge unit 11 through the lever type coupling joint 5, to prevent entry of foreign matters and impurities to the sleeve 4 through this connector 4*c*.

The holding device 6 is not limited to any specific construction as long as the distal end of the sleeve 4 is maintained as folded on one side surface of the main body 3. In this embodiment, a pair of buckles 62 are attached to the opposite surface through respective bands 61 and arranged with a suitable transverse spacing therebetween, and a pair of retaining bands 63 are attached to the one side surface of the main body 3 for suspending the corresponding buckles 62, respectively.

Each retaining band 63 includes an upper half 63*b* fixed to the main body 3, and a lower half 63 a foldable thereon. One of mating surfaces of the upper half 63*b* and lower half 63*a* has fixed thereto a male or hook surface 64*a* of a surface fastener 64, and the other, opposite surface has a female or loop surface 64*b*.

After folding the distal end of the sleeve 4 on the one side surface of the main body 3, the lower half 63*a* of each retaining band 63 is passed through the buckle 62. While being pulled up, the lower half 63*a* of each retaining band 63 is folded back on the upper half 63*b*, thereby engaging the hook surface 64*a* and loop surface 64*b* of the surface fastener 64. The distal end of the sleeve 4 is thereby maintained as folded on the side surface of the main body 3.

The holding device 6 may include a hook and eye, velveteen, button, surface fastener, and clip.

The main body 3 has four hook catches 7 arranged at suitable intervals circumferentially of an upper portion thereof. After the distal end of the sleeve 4 is folded on the one side surface of the main body 3, the holding device 6 holds the distal end of the sleeve 4 as folded on the side surface of the main body 3. Then, the container is held by means of the hook catches 7 and raised to an appropriate height with a hoist, for example. Subsequently, the input opening 2 is opened and a particulate material is fed into the flexible container 1 through the input opening 2.

When the distal end of the sleeve 4 is folded on the one side surface of the main body 3 as described above, the bottom plane of the main body 3 is closed by the opposite surface 4*b*. The distal ends of the one side surface 4*a* and opposite surface 4*b* are overlaid and are bent at the lower edge 3*a* of the main body 3, the space between the distal ends of the one lateral surface 4*a* and opposite surface 4*b* are also closed. Consequently, the particulate material is reliably prevented from being discharged through the sleeve 4 from inside the flexible container 1. Thus, there is no possibility of the particulate material in the flexible container 1 scattering to the ambient through the sleeve 4 when the particulate material is filled into the flexible container 1.

The flexible container 1 filled with a predetermined quantity of particulate material, with the input opening 2 sealed up, is transported to a predetermined storage location for storage or for subsequent transportation. During storage or transportation also, the holding device 6 holds the distal end of the sleeve 4 folded on the one side surface of the main body 3. Thus, there is no possibility of the particulate material in the flexible container 1 scattering to the ambient through the sleeve 4 during storage or transportation.

During storage or transportation of the flexible container 1 filled with the particulate material, a palette is not connected to the bottom of the flexible container 1, and moreover the distal end of the sleeve 4 remains folded on the one side surface of the main body 3. Therefore, compared with a conventional flexible container having a sleeve, hardly any increase occurs in volume or in weight (tare weight plus weight of the content) when the container is filled with the particulate material. As a result, storage cost and transmission cost never increase substantially when the container is filled.

Since no palette is connected to the bottom, hardly any increase occurs in tare volume or in tare weight of course, compared with the conventional flexible container having a sleeve. Thus, there occurs no increase in storage cost or transmission cost when the container is empty.

Moreover, according to this flexible container 1, the particulate material may be transmitted over a long distance and/or to a high location without scattering the particulate material at the destination, which is achieved by implementing the method and apparatus according to this invention as described hereinafter.

The method of this invention will be described in detail hereinafter. The flexible container used in the method of this invention will not be described, except a particularly important description, since it is a repetition of the foregoing detailed description of the flexible container of this invention.

In order to achieve a further reduction of the particulate material scattering to the ambient when the flexible container and discharge unit are connected or separated, the method of this invention uses the flexible container having a sleeve shaped such that at least the distal end and the connector are foldable on a side surface of the main body, with an end opening of the connector directed upward, and the discharge unit is connected to the connector in a state of at least the distal end and the connector of the sleeve folded on the side surface of the main body, with the end opening of this connector directed upward. Then, the distal end and the connector of the sleeve are unfolded to allow transmission of the particulate material.

It is recommended that the discharge unit is separated from the connector after completion of transmission of the particulate material, with at least the distal end and the connector of the sleeve folded on the side surface of the main body so that the end opening of this connector is directed upward.

In this case, in order that the particulate material scattering to the ambient may be reduced positively when the flexible container and discharge unit are connected or separated, it is preferable that holding means is provided on the main body and sleeve for holding at least the distal end and the connector of the sleeve as folded on the side surface of the main body, with the end opening of the connector directed upward. This, the end opening is directed upward when the flexible container and discharge unit are connected or separated.

Further, the operation is completed with the flexible container in a decompressed state. When the discharge unit is separated, ambient air is drawn through the separated portion, thereby further reducing scattering of the particulate material.

The flexible container and discharge unit may be connected by fitting and pressing the connector on an outer periphery of an opening of the discharge unit to the flexible container. Alternatively, a joint may be coupled to the connector and discharge unit. The latter is preferable from the point of view of promoting operability and controllability of a connecting operation. Thus, in the method of this invention, it is recommended that the connector and the discharge unit are connected through a joint.

The joint may be a threaded joint, union joint or flange joint. In order to further promote operability and controllability of the connection, it is preferable to use a quick joint such as a Machino quick joint or self-closing quick joint, or a lever type coupling joint which will be described later, which is connectable and separable by one-tough operation.

The fluid supplied under pressure into the flexible container through the discharge unit has a function to increase the fluidity of the particulate material and a function to discharge the particulate material into the transmitting pipe. Where, for example, the particulate material to be transmitted is a fine powder which easily becomes compact, depending on its transmission characteristics, it is particularly necessary to increase the fluidity of the particulate material. In the case of a particulate material in pellet form which has good fluidity, it is particularly necessary to control the inflow to the transmitting pipe of the particulate material.

Thus, in the method of this invention, where the partticulate material to be transmitted has high bulk specific gravity or fluidity, part of the fluid to be supplied into the flexible container is divided in the discharge unit, and this divided part is joined to a flow of the particulate material to be discharged into the transmitting pipe, with the fluidity increased in the flexible container. This facilitates the discharge and inflow of the particulate material to the transmitting pipe, whereby the particulate material is transmitted in an optimal condition.

In this case, a quantity of the fluid divided in the discharge unit and joined to the flow of the particulate material to be discharged into the transmitting pipe, with the fluidity increased in the flexible container, may be made adjustable. Then, the quantity of the fluid divided may be adjusted according to transmission characteristics of each of the different types of particulate material having varied levels of bulk specific gravity, whereby each particulate material is transmitted in an optimal condition.

In the method of this invention, a carrier fluid may be additionally supplied to the discharge unit and/or the transmitting pipe to increase transmitting distance or transmitting lift. This carrier fluid supplied additionally may be the very substance to be mixed into the particulate material, or may be a fluid containing the substance to be mixed into the particulate material. The substance to be mixed into the particulate material may include one which produces a chemical reaction through contact with the particulate material to be transmitted or one which does not. The substance which produces a chemical reaction may react efficiently by being mixed to the flow of the particulate material before arriving at the desired destination. The substance which does not produce chemical reaction may be mixed efficiently.

In this case, the carrier fluid source for additionally supplying the carrier fluid may comprise the fluid source for supplying the fluid to the discharge unit, or may be provided separately from this fluid source.

In additionally supplying the carrier fluid into the discharge unit or transmitting pipe, the carrier fluid may be forced toward the destination of the particulate material.

By using the ejecting action of the carrier fluid added, transmission quantity may be increased or supply pressure of the fluid source may be lowered. In the case of lowering the supply pressure of the fluid source, the fluid source may be small and inexpensive, and the flexible container and the discharge unit may be connected with increased assurance.

In the method of this invention, the particulate material may be separated from the carrier fluid once to be collected by the collecting means at the destination, and thereafter supplied to a processing apparatus in the first stage.

Where the particulate material need not be separated from the carrier fluid, or where the processing apparatus in the first stage includes means for separating the particulate material from the carrier fluid, the material may be transmitted directly to the processing apparatus in the first stage.

Where, in the method of this invention, the particulate material is separated from the carrier fluid by the collecting means at the destination, the method of separating the particulate material from the carrier fluid is not limited to a particular method. It is possible to employ a known gas-solid separating or liquid-solid separating method such as a precipitation or sedimentation method using gravity of the particulate material, a filtration method using filtering action of a filter, an inertial separation method using inertia of the particulate material, and electric attraction method which charges the particulate material and attracts it to electrodes, a coagulation method using a coagulant, or a method combining two or more of these methods.

It is preferably to employ, among these, a method requiring a simple construction to separate the particulate material from the carrier fluid and facilitating collection of the separated particulate material. From this point of view, a filtration method using a bag filter, the precipitation or sedimentation method, and an inertial separation method using a cyclone, are desirable.

In this method of this invention, the transmitting pipe may of course be opened and closed at appropriate points of time according to progress or an emergency situation in the first processing stage.

In the method of this invention, naturally, it is preferable that the particulate material does not remain in the flexible container when its transmission is completed. For this purpose, the flexible container may be tilted, shaken or struck from outside before completion of transmission, but such operations are troublesome. Depending on the way the discharge unit is connected, the above operations may result in the flexible container becoming detached from the discharge unit.

In the method of this invention, therefore, the flexible container may be forcibly expanded and contracted, preferably twice or three times, by varying internal pressure of the flexible container immediately before completion of the transmission, to drop the particulate material adhering to inner surfaces of the flexible container. This automatically prevents the particulate material from remaining in the flexible container.

That is, when the flexible container bag is expanded, creases of its inner surfaces are straightened thereby dropping the contents lodged in the creases. In this way, the contents are prevented from remaining in the flexible container bag by a so-called balloon effect. With vibration of the flexible container produced by repeated expansion and contraction, the particulate material is shaken off the inner surfaces thereby to prevent the contents from remaining in the flexible container bag.

Specific examples of the method of varying the internal pressure of the flexible container includes a method of varying the supply pressure and/or supply quantity from the fluid source into the flexible container, a method of varying a cross-sectional passage area of the transmitting pipe, a method of varying the supply pressure and/or supply quantity of the carrier fluid additionally supplied to the discharge unit and/or transmitting pipe, a method of opening and shutting or varying a cross-sectional passage area of an atmosphere communicating passage at the destination for releasing the carrier fluid to the atmosphere, a method of varying suction and/or draw quantity of the carrier fluid at the destination, and a method combining two or more of the above methods.

The method of varying the supply pressure and/or supply quantity from the fluid source into the flexible container includes a method of varying the supply pressure and/or supply quantity at the fluid source itself, and a method of releasing part of the fluid to an exhaust pipe, transmission pipe or to the atmosphere while maintaining the supply pressure and/or supply quantity at the fluid source constant.

The method of opening and closing or varying the cross-sectional passage area of the transmitting pipe may be executed by providing the transmitting passage with a gate or valve and opening and closing or varying an opening degree of the gate or valve. Where this valve or gate comprises a fully closable valve or gate, the valve or gate may be used also as a shutter for making and breaking transmission.

The method of varying the supply pressure and/or supply quantity of the carrier fluid additionally supplied to the discharge unit and/or transmitting pipe includes a method of varying the supply pressure and/or supply quantity at the carrier fluid source itself for supplying the carrier fluid, and a method of releasing part of the additionally supplied carrier fluid to a transmission pipe or to the atmosphere while maintaining the supply pressure and/or supply quantity at the carrier fluid source constant.

The method of opening and closing or varying the cross-sectional passage area of the atmosphere communicating passage at the destination for releasing the carrier fluid to the atmosphere may be executed by providing the atmosphere communicating passage with a gate or valve and opening and closing or varying an opening degree of the gate or valve.

The method of varying suction and/or draw quantity of the carrier fluid at the destination includes a method of varying the suction and/or draw quantity of suction means itself for drawing the carrier fluid, and a method of causing the suction means to draw atmosphere, thereby to reduce the ratio of the carrier fluid drawn to the suction means, while maintaining the suction and/or draw quantity of suction means itself constant.

Depending on the characteristics of the particulate material in the flexible container bag, the flexible container bag may naturally expand and contract just once immediately before completion of its transmission, but such expansion and contraction may not occur. It is therefore desirable, in order to reduce the residual content, to expand the flexible container bag forcibly or to repeat expansion and contraction, preferably twice or three times.

Thus, with the method acording to this invention, the connector of the flexible container is separated from the discharge unit of the particulate material transmitting apparatus after completion of transmission of the particulate material. As noted hereinbefore, the particulate material is prevented from scattering to the ambient when connecting the flexible container and particulate material transmitting apparatus. The particulate material is prevented from scattering to the ambient when separating the flexible container and particulate material transmitting apparatus. Receiving equipment may be simplified, which enables a reduction in equipment cost. Compared with the conventional flexible container having a discharge section, hardly and increase occurs in volume or in weight when the container is filled or in tare state. Storage cost and transmission cost may be kept low. The flexible container may be manufactured at low cost.

In the method of this invention, where the fluid is drawn by suction means, transmitting distance and transmitting lift may be increased markedly in addition to the above advantages. Consequently, for example, the particulate material may be transmitted by a single particulate material transmitting apparatus to a processing apparatus in the first stage from a receiving location, in which a plurality of particulate material transmitting apparatus are used conventionally.

In the method of this invention, where the particulate material is separated from the carrier fluid and the separated carrier fluid is drawn by suction at the destination, the supply pressure at the fluid source may be kept low to diminish a force acting on the connection between the discharge unit and flexible container, thereby reliably avoiding separation of the discharge unit and flexible container. Another advantage is that transmitting distance and/or transmitting lift may be increased relative to the supply pressure at the fluid source.

In the method of this invention, where the flexible container is forcibly expanded and contracted by varying internal pressure of the flexible container immediately before completion of the transmission, to drop the particulate material adhering to inner surfaces of the flexible container, the particulate material remains in a reduced quantity in the flexible container. The particulate material may be transmitted with hardly any part thereof left in the flexible container.

Figure 4:
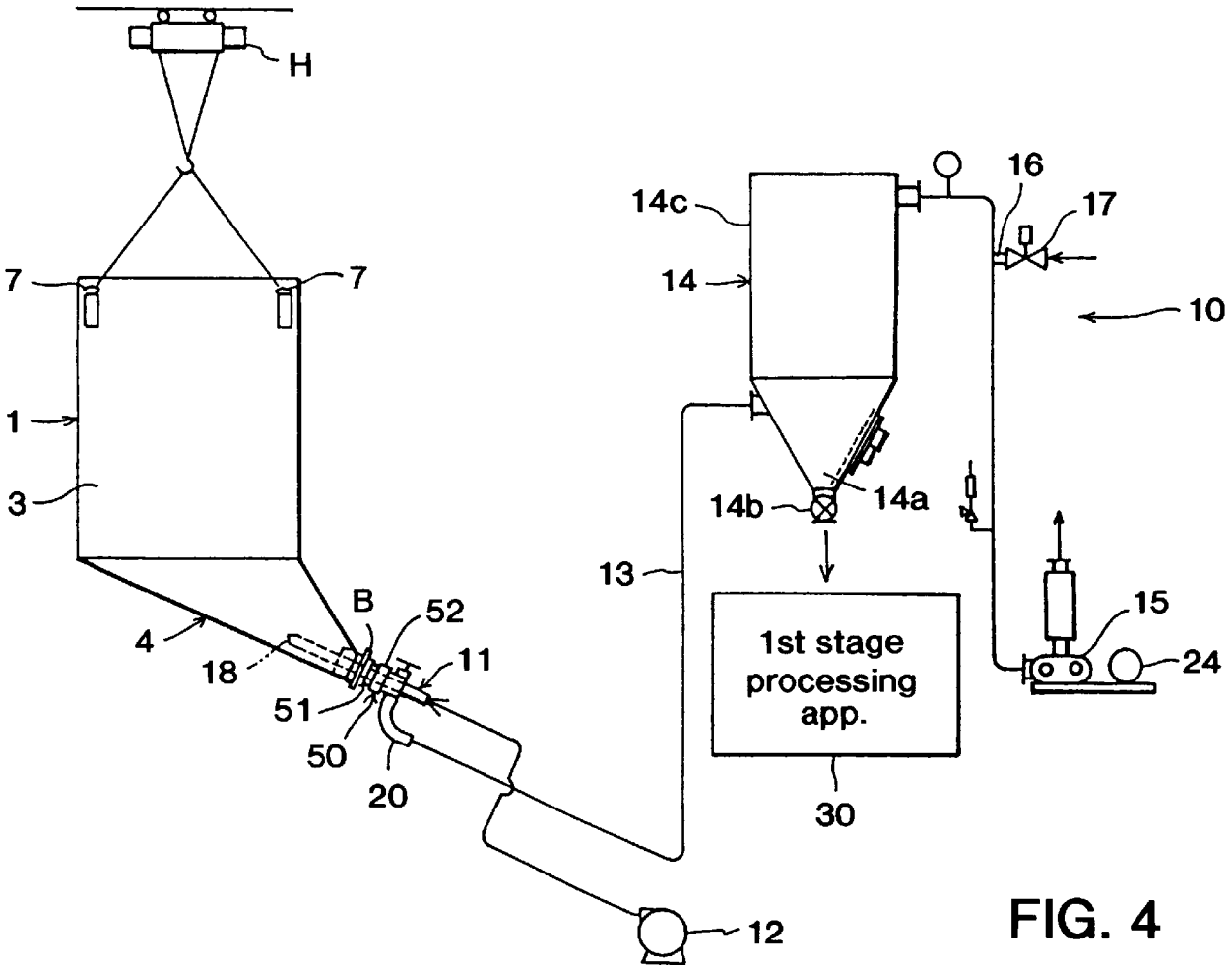
FIG. 4 is a diagram of an apparatus according to this invention.

In the method of transmitting a particulate material from a flexible container in one embodiment of this invention, as shown in FIG. 4, for example, the flexible container 1 transported to a destination is suspended and raised to an appropriate height and carried to a predetermined location by a hoist H engaging the hook catches 7, with the distal end of the sleeve 4 remaining folded on the one side surface of the main body 3. In the predetermined location, the cap 57 is removed from the distal end of the sleeve 4 folded on the one side surface of the main body 3. Then, the discharge unit 11 of the particulate material transmitting apparatus 10 is connected in a sealed condition to the distal end connector 4*c* of the sleeve 4 through the lever type coupling joint 5.

According to this method, the discharge unit 11 of the particulate material transmitting apparatus 10 is connected to the connector 4*c* of the sleeve 4 while the holding device 6 holds the distal end of the sleeve 4 folded on the one side surface of the main body 3. Thus, there is no possibility of the particulate material in the flexible container 1 scattering to the ambient through the sleeve 4 when the discharge unit 11 is connected.

In this method, the sleeve is released from the holding action of the holding device 6 to open the sleeve 4. Specifically, the holding action of the holding device 6 is reversed by manually pulling the distal ends of the lower halves 63*a* of the fasteners 64, thereby opening the surface fasteners 64, of the holding device 6 holding the sleeve 4 folded on the one side surface of the main body. Then, as shown in FIG. 3, the sleeve 4 is naturally opened into a funnel shape with an axis thereof inclined downward with respect to the axis of the main body 3, under the weight of the particulate material in the main body 3.

The holding device 6 and hook catches 8 are not shown in FIG. 3.

When the sleeve 4 is opened in this way, the particulate material in the main body 3 falls into the sleeve 4, and fills areas around a supply pipe 18 of the discharge unit 11 described later and the interior of a discharge pipe 19 of the discharge unit 11 described later. The particulate material having fallen into the sleeve 4, as it is, has low fluidity. According to this method, therefore, after the sleeve 4 is opened, a fluid, which is air in this example, is fed from a fluid source 12 of the particulate material transmitting apparatus 10 through the supply pipe 18 of the discharge unit 11 into the flexible container 1.

The air flow supplied under pressure increases the fluidity of the particulate material. With the air flow supplied under pressure acting as a carrier fluid, the particulate material of increased fluidity is fed, under the internal pressure of the flexible container 1, into a transmitting pipe 13 of the particulate material transmitting apparatus 10 through the discharge pipe 19 of the discharge unit 11, to be transmitted to a collecting device 14.

When the particulate material in the sleeve 4 is discharged to the transmitting pipe 13 through the discharge unit 11, the sleeve 4 is replenished with the particulate material from inside the main body 3 in a quantity corresponding to the quantity discharged. As a result, the particulate material in the flexible container 1 is successively discharged to the transmitting pipe 13 through the discharge unit 11.

The apparatus of this invention will be described in detail hereinafter.

The flexible container used in the apparatus of this invention will not be described since it is a repetition of the foregoing detailed description of the flexible container of this invention.

In the apparatus of this invention, as noted in the detailed description of the flexible container of this invention, it is preferable, without limiting the invention, that the connector of the flexible container and the connected portion of the discharge unit are connected through a joint in order to assure a sealed connection between the connector of the flexible container and the discharge unit.

With this construction, there is no need to bind with a string or the like, which greatly simplifies a connecting operation. The connector may comprise a nozzle or the like formed of metal, synthetic resin or fiber reinforced synthetic resin.

That is, it is preferable that the connected portion has a female or male joint corresponding to a male or female joint of the connector. It is particularly preferred that the male or female joint of the connector and the female or male joint of the connected portion are connectable and separable by one-touch operation, in order to promote operability.

Other details of the joint for connecting the connector of the flexible container and the connected portion of the discharge unit will not be described here to avoid repetition.

In the apparatus of this invention, the connection between the fluid source and the supply pipe of the discharge unit, and the connection between the discharge pipe of the discharge unit and the transmitting pipe, may be made as in the prior art. For example, a terminal pipe of the fluid source may be fitted in or on a distal end of the supply pipe, and one of the distal end of the supply pipe and the terminal pipe of the fluid source may be tightened to the other by binding means such as a metal band. As in the connection between the sleeve and the discharge unit, a joint may be used for increased reliability of the connection, thereby to increase transmitting distance and/or transmitting lift. This joint may comprise, for example, a joint for directly coupling pipes such as a flange, socket, union or spigot joint, a joint with a curved pipe such as an elbow or bend, or a joint having a branch such as T-, cross or Y-joint.

Other details of the discharge unit in the apparatus of this invention will not be described here, which will be described later in connection with the unit according to this invention.

The fluid source in the apparatus of this invention serves the purpose if constructed to supply fluid to the supply pipe of the discharge unit. For example, the fluid source for supplying a gas may comprise a known air pump such as a reciprocating air pump, rotary air pump or ejector-type air pump (jet pump), a blower such as an axial blower, centrifugal blower or mixed flow blower, an air compressor, a pressure vessel storing a varied pressure gas, or a liquefied gas vessel storing a varied liquefied gas. Among these, a blower is recommended since it has a simple construction and yet is capable of supplying a large quantity of pressurized air steadily over a long period.

The transmitting pipe in the apparatus of this invention is not limited to any particular material as long it communicates at one end thereof with the discharge pipe of the discharge unit. It may be formed of metal, synthetic resin or fiber reinforced synthetic resin, for example. It is preferable to use a material having inner surfaces least worn through transmission of a transmitted material. It is also preferable that at least part of it is formed of flexible hose or a revolving joint is interposed to facilitate attachment and detachment of the discharge unit to/from the flexible container.

Furthermore, in the apparatus of this invention, under the pressure of the fluid introduced under pressure from the fluid source through the supply pipe into the flexible container, the material to be transmitted is forced into the discharge pipe and transmitted through the transmitting pipe along with the fluid acting as a carrier fluid. The apparatus may further comprise means, as necessary, for additionally supplying a carrier fluid to the discharge pipe and/or the transmitting pipe to increase the transmitting distance and/or the transmitting lift.

This carrier adding means may include an ejector nozzle for forcing a carrier fluid in a downstream direction of the flow of the particulate material. According to the carrier adding means including the ejector nozzle, the particulate material and carrier fluid upstream of the ejector nozzle may be drawn and transmitting speed and transmitting pressure may be increased downstream of the ejector nozzle. As a result, the particulate material may be transmitted over a longer distance and/or to a higher location.

The carrier fluid forced out of the carrier adding means serves the purpose if it is a fluid usable as a carrier fluid. Where a step is provided for mixing a certain substance and the particulate material, the substance to be mixed with the particulate material or a fluid containing this substance may be forced out of the ejector as a carrier fluid. Consequently, the substance and the particulate material may be mixed quickly and uniformly during transmission while transmitting the particulate material over a long distance and/or to a high location, thereby reducing the number of processing steps. Where this substance is reactive to the particulate material, the particulate material and this substance may react quickly and uniformly.

The apparatus of this invention may include a valve for opening and closing the transmitting pipe as necessary. By closing the transmitting pipe with this valve, the transmission of the particulate material may be suspended or stopped at a selected time in response to a state of or an emergency situation occurring at the destination, for example.

In addition, the apparatus of this invention may include collecting means at the destination, as necessary, for separating the particulate material from the carrier fluid and collecting the particulate material. This collecting means may comprise, for example, a filter device having a filter of bag-like or other shape to act on the fluid flow, a sedimentation or precipitation chamber for separating the particulate material by gravity, an inertial separation device for separating the particulate material by inertia at a turning point after flowing through a winding or curved passage, a cyclone for forming spiral flows inside the separator to separate the particulate material by inertia, a separator sheet for separating the particulate material by filtration, or a combination of two or more of the above devices.

Among these collecting means, the bag filter, sedimentation or precipitation chamber or cyclone is recommended which allows the particulate material to be transmitted to a subsequent stage and yet enables a simple and inexpensive construction.

An atmosphere communicating passage may be connected to the collecting means for communicating the collecting means with the atmosphere for releasing the separated carrier fluid to the atmosphere. Alternatively, suction means may be provided for drawing the carrier fluid separated by the collecting means, in order to reliably prevent the flexible container from becoming detached from the discharge unit by maintaining the supply pressure of the fluid source below a fixed level, and to increase the transmitting distance and the transmitting lift remarkably. Then, the particulate material may be transmitted from a receiving location by a single particulate material transmitting apparatus to a processing apparatus in the first stage for which a plurality of particulate material transmitting apparatus are used conventionally. The atmosphere communicating passage and suction means may both be provided where an atmosphere communicating valve is mounted in the atmosphere communicating passage for opening and closing the latter.

The apparatus of this invention may further comprise means for varying internal pressure of the flexible container to expand and contract the flexible container as necessary. The particulate material remaining in the flexible container may be reduced by expansion and contraction of the flexible container.

The means for varying the internal pressure of the flexible container includes means for varying the supply pressure to the flexible container, means for varying a cross-sectional passage area of the transmitting pipe, means for varying the quantity or supply pressure of the carrier fluid additionally supplied from the carrier fluid adding means, means for varying the cross-sectional passage area of the atmosphere communicating passage for communicating the collecting means to the atmosphere, and means for varying suction of the suction means for drawing the carrier fluid separated by the collecting means.

Depending on the characteristics of the particulate material in the flexible container bag, the flexible container bag may naturally expand and contract just once immediately before completion of its transmission, but such expansion and contraction may not occur. It is therefore desirable, in order to reduce residual content, to provide the above means for varying the internal pressure of the flexible container, to expand and contract the flexible container bag forcibly, preferably twice or three times, immediately before completion of transmission.

The collecting device 14 is installed at a receiving end of the particulate material transmitting apparatus 10. The particulate material transmitted from the flexible container 1 through the transmitting pipe 13 of the particulate material transmitting apparatus 10 is separated from the carrier fluid and collected by the collecting device 14 at the receiving end. Then, the material is fed down to a processing apparatus 30 in a first stage from a discharge valve 14*b* disposed in a lower position of a main body 14*a* of the collecting device 14.

The main body 14*a* of the collecting device 14 has, in an upper position thereof, a dust removing section 14*c* for reliably removing fine particles of dust from the carrier fluid separated in the main body 14*a*. An atmosphere communicating passage 16 releses the carrier fluid stripped of dust in the dust removing section 14*c* to the atmosphere, an atmosphere communicating valve 17 opens and closes the atmosphere communicating passage 16, a suction device 15 communicates with the dust removing section 14*c* through a position of the atmosphere communicating passage 16 upstream of the atmosphere communicating valve 17. In time of transmission, the atmosphere communicating valve 17 is closed and the suction device 15 is operated to draw the carrier fluid from the collecting device 14.

Consequently, the fluid from fluid source 12 may have a reduced supplying pressure, so that the fluid source 12 may be compact and inexpensive. This also positively prevents separation of the discharge unit 11 and sleeve 4, and separation of a terminal pipe of the fluid source 12 and transmitting pipe 13.

By using the suction device 15 in this way, the transmitting ability of the particulate material transmitting apparatus 10, i.e. transmitting distance and transmitting lift, may be increased. As a result, only one particulate material transmitting apparatus 10 is needed between the receiving location and the first stage processing apparatus installed at a distance, for example, of 15 to 30 meters from the receiving location, in contrast to the prior art requiring particulate material transmitting apparatus in a plurality of stages. It is therefore possible to reduce equipment cost markedly.

Depending on the characteristics of the particulate material in the flexible container 1, the flexible container 1 may naturally expand and contract just once immediately before the end of transmission. Such expansion and contraction are unstable, i.e. variable with flow characteristics of the particulate material and setting conditions of the apparatus.

With the expansion and contraction of the flexible container 1, any residual part of the particulate material adhering to inner surfaces of the flexible container 1 is separated from the inner surfaces of the flexible container 1 by the so-called balloon effect, the particulate material falls into the sleeve 4 to be discharged from the discharge unit 11 into the transmitting pipe 13. Thus, a reduced quantity of the particulate material remains in the flexible container 1.

However, such expansion and contraction of the flexible container 1 may not occur. In this embodiment, therefore, the atmosphere communicating valve 17 is operated twice or three times immediately before the end of transmission, to vary the internal pressure of the flexible container 1. Thus, expansion and contraction of the flexible container 1 are forcibly repeated twice or three times.

Consequently, the particulate material adhering to the inner surfaces of the flexible container 1 falls off by the so-called balloon effect occurring when the flexible container 1 is expanded, and falls off by vibration of the main body 3 of the flexible container 1 caused by the repeated expansion and contraction, by which the particulate material falls into the sleeve 4 to be transmitted by the particulate material transmitting apparatus 10. As a result, almost no particulate material remains in the flexible container 1.

As shown in FIGS. 1 through 3, a pair of hook catches 8 are provided in lower positions of a lateral surface opposite to the one lateral surface of the main body 3 continuous with the lateral surface 4*a*. For example, the hook catches 7 in upper positions of one lateral surface of the main body 3 and these hook catches 8 may be engaged to suspend the flexible container 1 at an angle, so that the axis (not shown) of the opened sleeve 4 extends substantially vertically. In this case, the particulate material hardly remains in portions of the flexible container 1 opposite to the above one lateral surface, where the particulate material would otherwise tend to remain.

In FIG. 4, numeral 24 denotes a motor for driving the suction device 15.

In this method, the fluid source 12 is stopped at an appropriate time after transmission. The sleeve 4 to which the discharge unit 11 remains connected is folded on the one lateral surface of the main body 3, with its end opening directed upward. The holding device 6 holds the sleeve 4 in this position.

The discharge unit of this invention will be described in detail hereinafter.

In the discharge unit of this invention, the supply pipe and discharge pipe may be arranged parallel to each other. The supply pipe and discharge pipe may be arranged with axes thereof crossing each other inside the flexible container connected to the connected portion. However, it is preferable that the supply pipe and discharge pipe are arranged coaxially one outside the other, in order to promote operability in attachment to and detachment from the flexible container and to reduce the particulate material remaining in the flexible container.

In this case, jet openings for jetting the fluid from the supply pipe into the flexible container may be opened inside the discharge pipe. However, it is preferred that, in order to enlarge a range of increasing fluidity of the particulate material with inflow of the fluid, the connected portion is formed at a distal end of the discharge pipe, a distal end of the supply pipe projects further than this connected portion, and a portion of the supply pipe projecting further than this connected portion defines jet openings for jetting the fluid into the flexible container. It is particularly preferable that the supply pipe defines jet openings distributed in a peripheral surface thereof within a predetermined range axially of the supply pipe.

Where, as noted above, the portion of the supply pipe projecting further than the connected portion defines jet openings, part or whole of the distal end of the supply pipe, preferably, is closed in order to increase the quantity of pressurized fluid jetting out of the jet openings ad to avoid a difficulty in inserting the supply pipe into the sleeve due to clogging of the supply pipe with the particulate material in the flexible container. It is particularly preferable to provide a tapered, conical end element.

As noted in the detailed description of the method and apparatus of this invention, the discharge unit of this invention may further comprise a bypass passage for communicating the supply pipe directly to the discharge pipe. By supplying the fluid directly to the discharge pipe through this bypass passage, it is possible to transmit a particulate material of high fluidity and high bulk specific gravity. In this case, a bypass valve may be provided for opening and closing or adjusting an opening degree of the bypass passage. By opening and closing or adjusting the opening degree of the bypass passage, plural types of particulate materials having varied levels of fluidity and bulk specific gravity may be transmitted in an optimal condition according to transmission characteristics of each material.

Where, in the discharge unit of this invention, as noted above, the supply pipe and discharge pipe are arranged coaxially one outside the other, the connected portion is formed at the distal end of the discharge pipe, the distal end of the supply pipe projects further than the connected portion, and the portion of the supply pipe projecting further than the connected portion defines jet openings for jetting the fluid into the flexible container, it has been found that the flow of the particulate material formed inside the discharge pipe could stagnate therein and, when the discharge unit of this invention is separated from the sleeve, the stagnant particulate material could spin outside the sleeve to be scattered to the ambient.

Thus, it is recommended that the discharge unit of this invention further comprises means for forming spiral flows in the discharge pipe to prevent stagnation which would cause the particulate material to remain in the discharge pipe.

Specific examples of the means for forming spiral flows in the discharge pipe include guide plates for guiding inflows to the discharge pipe in spiral directions, and nozzles for jetting a fluid tangentially of the discharge pipe. Apart from these, spiral flows may be formed in the discharge pipe by connecting the transmitting pipe to the discharge pipe tangentially of the discharge pipe. It is of course possible to combine two or more of the above devices. Among these, the guide plates are recommended since the construction is simple. Preferably, the guide plates are supported by outer peripheral surfaces of the supply pipe or inner peripheral surfaces of the sleeve. Particularly, support by the outer peripheral surfaces of the supply pipe is preferred.

The supply pipe and discharge pipe of the discharge unit of this invention are not limited to any particular material, but a preferred material is chemically inactive to varied particulate materials and has good wear resistance. Thus, stainless steel or other metals or synthetic resin may be used. A different material may be used, which has surfaces clad, coated or lined with such a chemically inactive and wear-resistant material.

Subsequently, the discharge unit 11 is separated from the sleeve 4 by a one-touch operation in a procedure reversed from the connecting procedure. Scattering to the ambient of the particulate material in time of separating the discharge unit 11 is almost completely eliminated since the particulate material hardly stagnates between sleeve 4 and discharge unit 11 during transmission, and since the particulate material remaining in the discharge unit 11 falls into the sleeve 4 when the sleeve 4 is folded on the one lateral surface of the main body 3.

As shown in FIG. 5, the discharge unit 11 has a double, inner and outer, pipe construction including the supply pipe 18 and discharge pipe 19. A terminal pipe 12*a* of the fluid source 12 is connected in communication and in a sealed condition to a proximal end of the supply pipe 18. A leading end of the transmitting pipe 13 is connected in communication and in a sealed condition directly or through an elbow pipe 20 to a proximal end of the discharge pipe 19, with a connectable element comprising a female joint 52 of the lever type coupling joint 5 being provided for its end opening.

The lever type coupling joint 5 includes the male joint 51 provided for the connector 4*c* of the sleeve 4, the female joint 52 supported by a distal end of the discharge pipe 19, levers 53 supported by the female joint 52 to be pivotable within a predetermined range about axes parallel to tangents of the discharge pipe 19, cams 54 formed adjacent supporting points of the levers 53, and a circumferential groove 55 formed over an entire circumference of the male joint 51. By turning the levers 53 with the male joint 51 inserted into the female joint 52, the cams 54 formed in forward ends of the levers 53 are driven into the circumferential groove 55 of the male joint 51 to draw the male joint 51 into the female joint 52.

Only one lever and one cam may be provided in integrated form. However, to increase reliability of the connection, levers 53 and cams 54 may be provided in two positions equidistantly spaced circumferentially of the female joint 52. In order to increase reliability of the connection further, it is of course possible to provide them in four or more positions equidistantly spaced circumferentially of the female joint 52. However, an increased number thereof is disadvantageous in improving operability of attachment and detachment. Thus, the desired number thereof is two or three, and the number here is two for operability.

That is, this lever type coupling joint 5 is coupled easily in, as it were, a one-touch operation by spreading the levers 53, holding each in one hand, fitting the female joint 52 over the male joint 51, and then turning the two levers 53 in closing directions at the same time.

Of course, the two levers 53 may be turned in the closing directions successively. However, the above simultaneous turning operation is preferable for higher operating efficiency.

The female joint 52 has, if necessary, a seal element 56 opposed to a distal end surface of the male joint 51. The seal element 56 presses on the distal end surface of the male joint 51 drawn into the female joint 52 by the operation of the levers 53, whereby the male joint 51 and female joint 52 are connected in communication with each other in a sealed condition.

The terminal pipe 12*a* of the fluid source 12 is fitted on the leading end of the supply pipe 18 and tightened thereto with a metal band B1, to communicate with the supply pipe 18 in a sealed condition. Consequently, the terminal pipe 12*a* is reliably prevented from slipping off the leading end of the supply pipe 18. The distal end of the transmitting pipe 13 is likewise fitted on the elbow pipe 20 communicating with the discharge pipe 19, and tightened thereto with a metal band B2, to communicate with the discharge pipe 19 in a sealed condition. Consequently, the transmitting pipe 13 is reliably prevented from slipping off the elbow pipe 20.

In this way, reliable connections are made between the supply pipe 18 of the discharge unit 11 and the terminal pipe 12*a* of the fluid source 12, between the discharge pipe 19 of the discharge unit 11 and the transmitting pipe 13, and between the discharge unit 11 and the sleeve 4 of the flexible container 1. By drawing the fluid, i.e. air in this case, by means of the suction device 15, the transmitting capabilities, i.e. transmitting distance and transmitting lift, of the particulate material transmitting apparatus 10 are remarkably improved. As a result, only one particulate material transmitting apparatus 10 is needed between the receiving location and the first stage processing apparatus 30 installed at a distance, for example, of 15 to 30 meters from the receiving location, in contrast to the prior art particulate material transmitting apparatus requiring a plurality of stages. It is therefore possible to reduce equipment cost markedly.

As shown in FIGS. 4 and 5, the supply pipe 18 of the discharge unit 11 has the distal end thereof projecting further than the distal end of the discharge pipe 19. A portion of the supply pipe 18 projecting by a fixed extent further than the distal end of the discharge pipe 19 has a peripheral wall formed of a perforated metal 18*a*, and a distal end thereof is defined by a tapered conical end element 18*b*.

Thus, when air flows of predetermined pressure are supplied from the fluid source 12 into the supply pipe 18 of the discharge unit 11 after connecting the discharge unit 11 to the distal end of the sleeve 4, the air flow moves into the sleeve 4 through the entire circumference of the perforated metal 18*a* of the supply pipe 18, to increase the fluidity of the particulate material in the sleeve 4.

The distal end of the supply pipe 18 projects further than the distal end of the discharge pipe 19, and the supply pipe 18 communicates with the interior of the sleeve 4 through the portion of the supply pipe 18 projecting by a fixed extent further than the distal end of the discharge pipe 19, i.e. the portion of perforated metal 18*a*. Therefore, the air flow jetting from the supply pipe 18 is prevented from flowing directly into the discharge pipe 19 without mixing into the particulate material, thereby enlarging a range of increased fluidity of the particulate material in the sleeve 4.

Since the distal end of the supply pipe 18 is closed by the conical end element 18*b*, the air flow supplied to the supply pipe 18 may be caused to jet out through the perforated metal 18*a* into the sleeve 4. This provides the effect of further enlarging the range of increased fluidity of the particulate material in the sleeve 4.

Further, since the end element 18*b* of the supply pipe 18 has a tapered conical shape, when inserting the supply pipe 18 into the sleeve 4 to connect the discharge unit 11, the distal ends of the one lateral surface 4*a* and the opposite surface 4*b* of the sleeve 4 that overlap each other are smoothly opened to facilitate insertion of the supply pipe 18 into the sleeve 4.

Since the distal end of the supply pipe 18 is closed by the end element 18*b*, the distal end of the supply pipe 18 is not clogged by the particulate material even if the particulate material leaks out into the sleeve 4 when the supply pipe 18 is inserted. Thus, the supply pipe 18 may easily be inserted into the sleeve 4 and secured thereto by a band B.

As described above, when the air flow of predetermined pressure is supplied from the fluid source 12 into the supply pipe 18 of the discharge unit 11 after connecting the discharge unit 11 to the distal end of the sleeve 4, the air flow moves into the sleeve 4 to increase the fluidity of the particulate material in the sleeve 4. The particulate material flows smoothly into the discharge pipe 19, and further flows from the discharge pipe 19 into the transmitting pipe 13 connected thereto through the elbow pipe 20, to be transmitted to the collecting device 14. However, in actual transmission of the particulate material, it is necessary to vary transmitting conditions according to various characteristics such as the type, grain size and density, i.e. transmission characteristics, of the particulate material to be transmitted.

For this purpose, the discharge unit 11 includes a bypass passage 21 for dividing the air flow so that some of the air flow flows from the supply pipe 18 directly into the discharge pipe 19, bypassing the flexible container 1, and an adjusting valve 22 for adjusting a sectional passage area of the bypass passage 21 between fully open and fully closed.

In the case of a particulate material of low bulk specific gravity such as impalpable powder, fluidity is increased easily with a fluid inflow, to facilitate its transmission over a long distance or to a high location. It is desirable to transmit the particulate material with a reduced transmitting pressure while reducing the flow rate.

In this case, the adjusting valve 22 is fully closed to allow the entire quantity of air flow supplied to the supply pipe 18 to jet out into the sleeve 4 of the flexible container 1. The particulate material of low bulk specific gravity is transmitted under a transmitting pressure reduced by the inflow to the flexible container 1, to increase its collecting rate. That is, the adjusting valve 22 is fully closed whereby, as shown in a performance curve in FIG. 6, for example, 1550 kg of calcium carbonate powder are transmitted over a long distance of 30 meters per hour.

Figure 6:
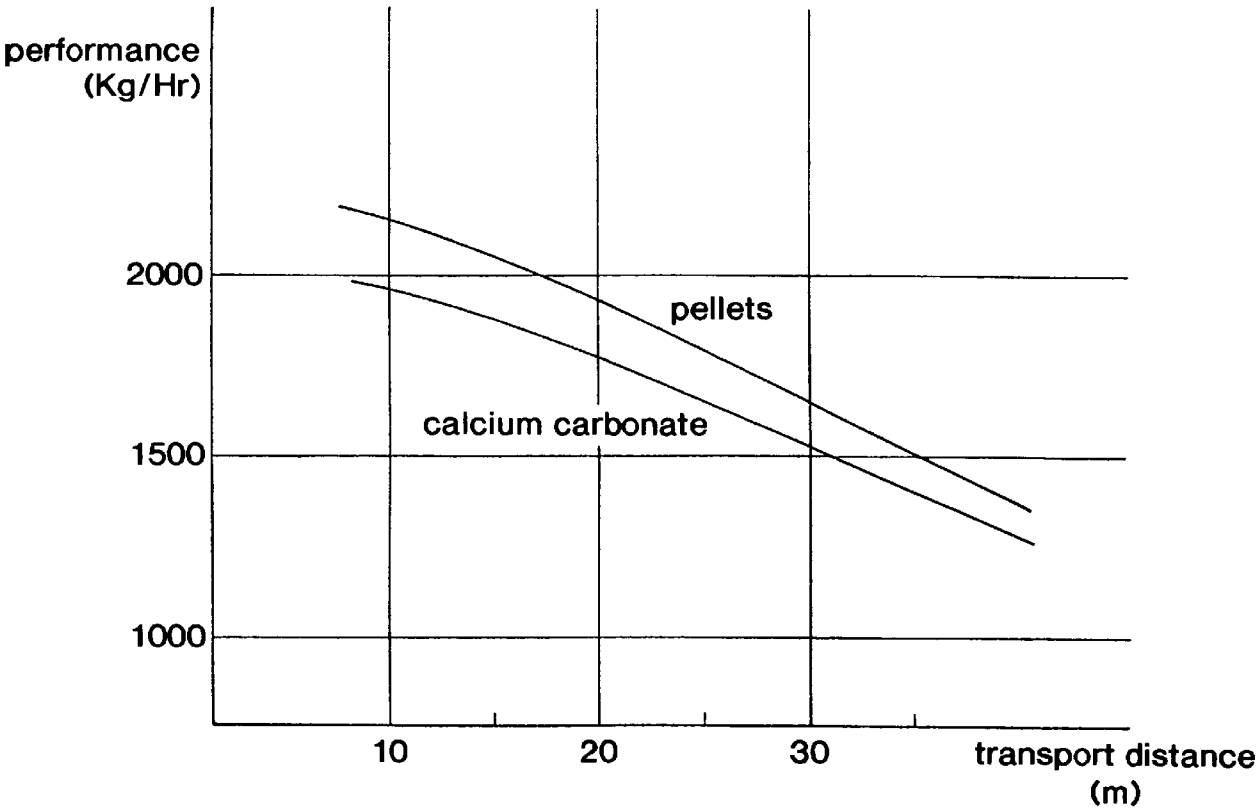
FIG. 6 is a view of transmission characteristics in one embodiment showing a particulate material transmitting performance of the apparatus according to this invention.

In the case of a particulate material of high fluidity such as pellets, an increased quantity of air flow into the discharge pipe 19. It is therefore difficult to transmit the particulate material over a long distance or to a high location without increasing the transmitting pressure or suction. However, by appropriately opening the adjusting valve 22 according to the level of fluidity of the particulate material, the high pressure air whose pressure is not reduced by inflow to the flexible container 1 is supplied to the discharge pipe 19 through the bypass passage 21 to increase the transmitting pressure or the suction of the suction device 15. Thus, the particulate material of high bulk specific gravity may be transmitted over a long distance or to a high location. That is, as shown in FIG. 6, it is possible to transmit 1700 kg of pellets over the long distance of 30 meters per hour.

As noted hereinbefore, there is no possibility of the particulate material scattering to the ambient when the discharge unit 11 is separated from the sleeve 4. According to the discharge unit 11, the elbow pipe 20 is connected to a peripheral surface of the discharge pipe 19 adjacent a deep end surface thereof in a normal line direction. The particulate material could stagnate adjacent the deep end surface to be lodged therein during transmission. This particulate material could fall outside the sleeve 4 when the discharge unit 11 is separated from the sleeve 4.

In this embodiment, as shown in FIG. 5, guide plates 23 are mounted in the discharge pipe 19 for forming spiral air flows to prevent the particulate material from stagnating and remaining in the discharge pipe 19. Thus, the particulate material is reliably prevented from scattering to the ambient when the discharge unit 11 is separated from the sleeve 4.

Figure 7:
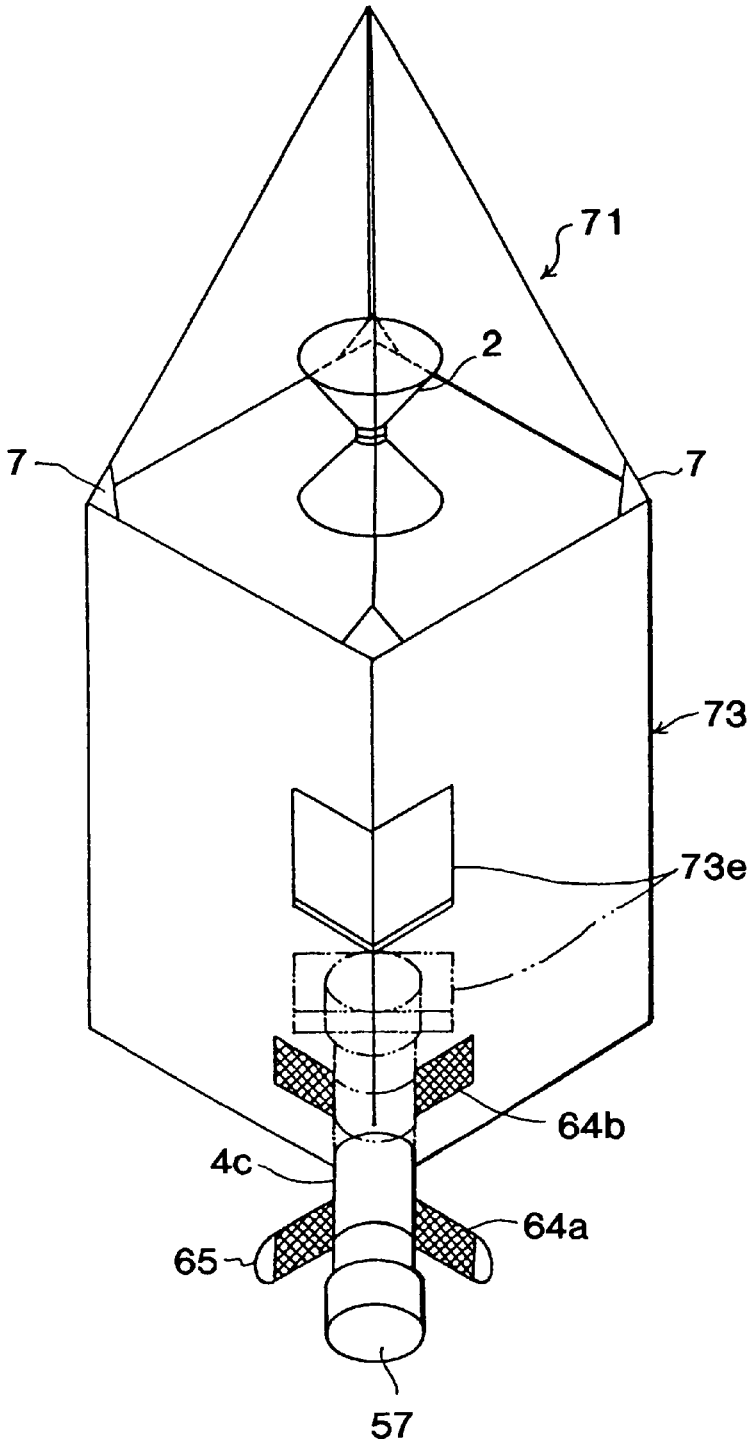
FIG. 7 is a perspective view of a further flexible container according to this invention.

A flexible container 73 in another embodiment of this invention, as shown in FIG. 7, includes a sleeve 74 drawn from one lower corner of a main body 73 and opened to a cylindrical shape having a horizontal axis. The sleeve 74 has a belt 65 fixed to a distal end thereof and projecting from opposite sides of the sleeve 74 when the latter is folded. A surface fastener 65*a* and 65*b* is provided on the belt 65 and on portions of the main body 73 corresponding to projecting portions of the belt 65. A sheet-like cover 73*e* is provided in a vertically intermediate portion of the main body 73 for covering an end opening of the sleeve 74 folded on side surfaces of the main body 73 with the end opening directed upward hook catches 77 are provided for lifting the device.

This embodiment is the same as the foregoing embodiment in the other aspects of construction, operation and effect, whose description will be omitted to avoid repetition.

Figure 8:
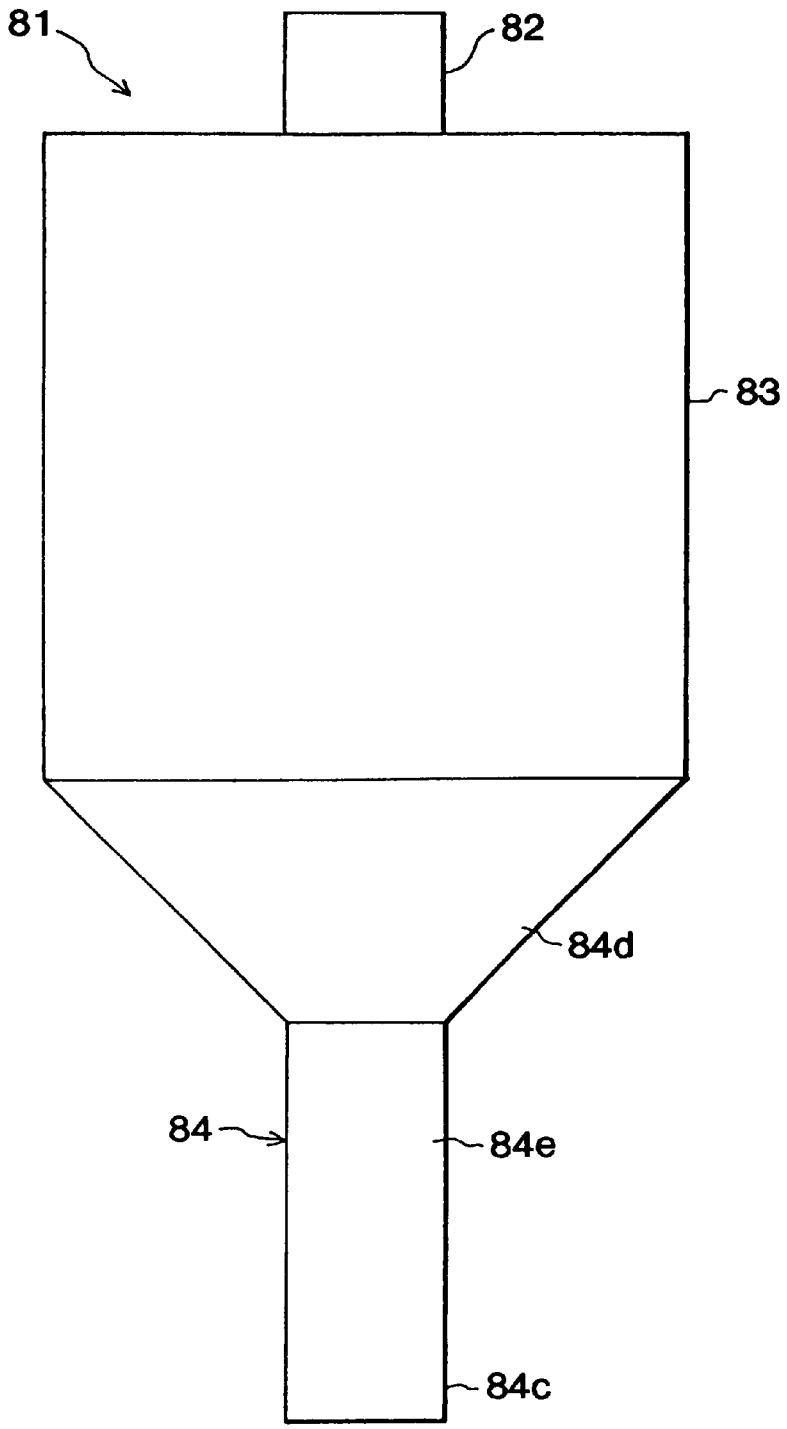
FIG. 8 is a perspective view of a further flexible container according to this invention.

A flexible container 81 in a further embodiment of this invention, as shown in FIG. 8, includes a sleeve 84 formed integral with a main body 83 to be opened to a shape of a square funnel 84*d* having a vertical axis and a cylindrical portion 84*e* continuous from a lower end thereof. The sleeve 84 is sealed, before introducing a particulate material via an opening 82, by binding a vertically intermediate position of the cylindrical portion 84*e* with a string, for example. Then, the cylindrical portion 84*e* is turned back at the bound position to be bound.

Figure 9:
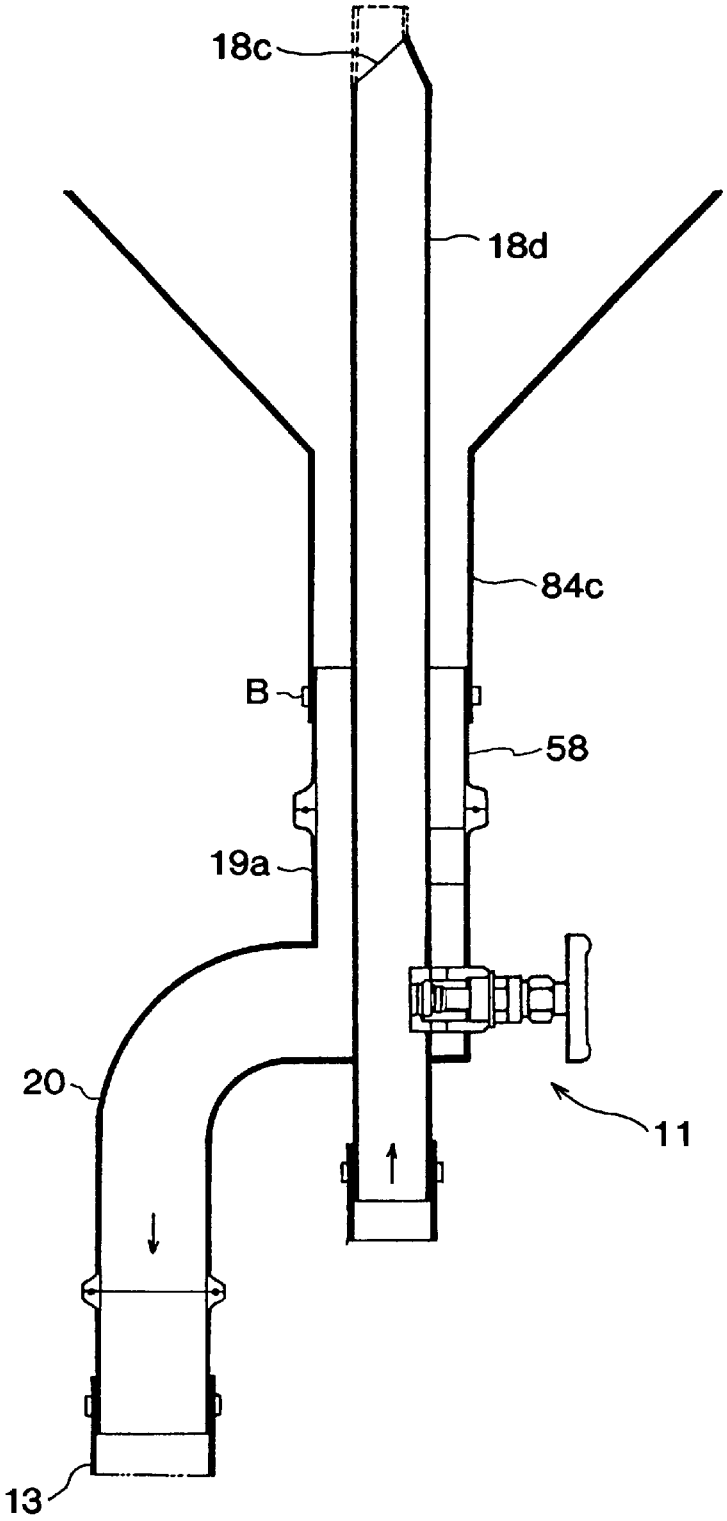
FIG. 9 is a sectional view of a unit in one embodiment of this invention.
Figure 10:
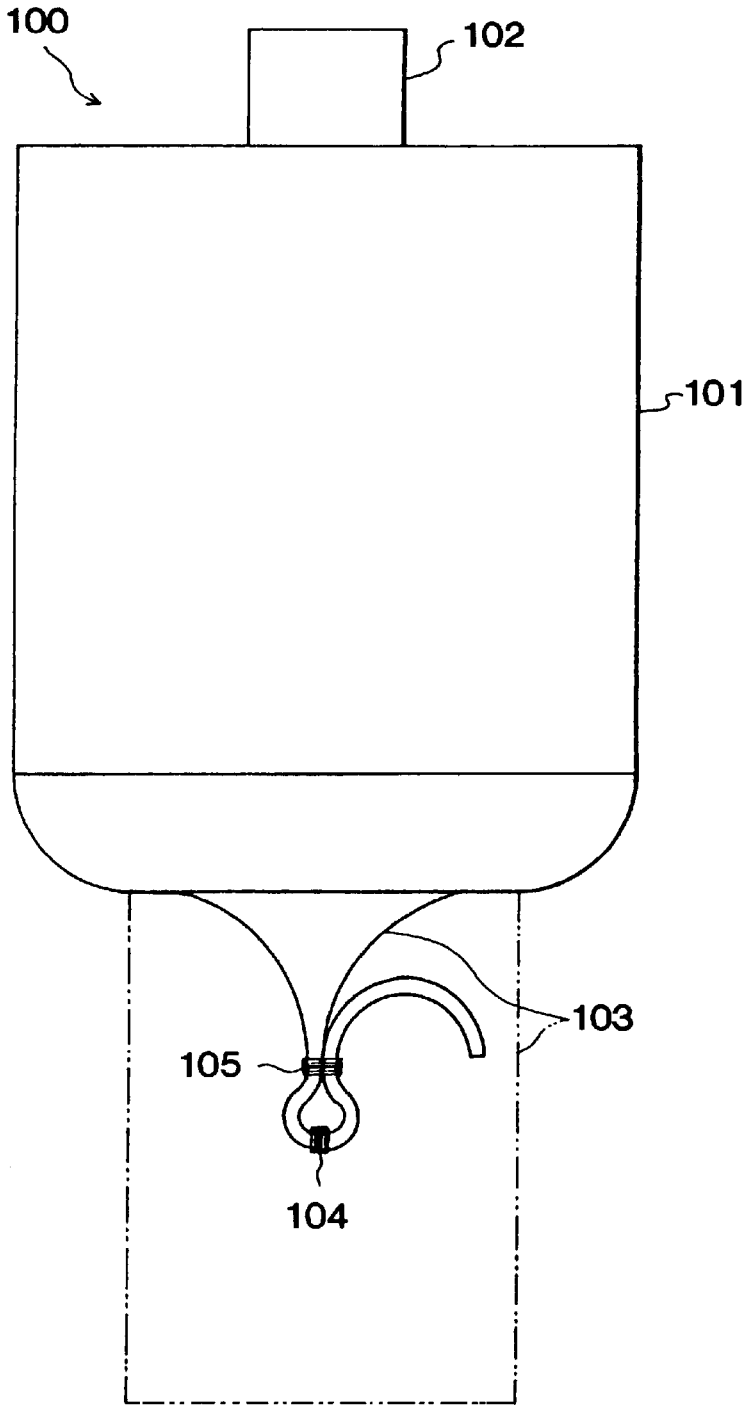
FIG. 10 PRIOR ART
FIG. 10 is a side view of a conventional flexible container.
Figure 11:
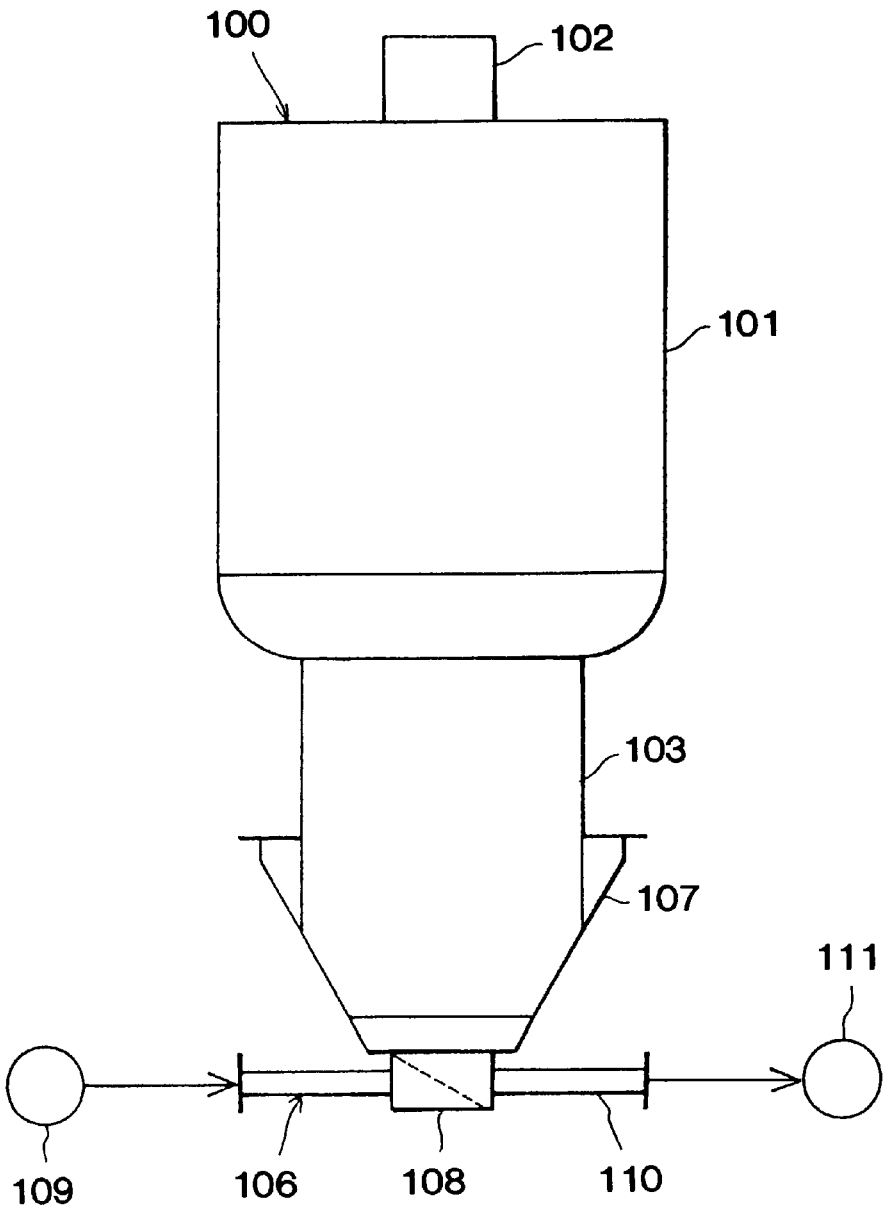
FIG. 11 PRIOR ART
FIG. 11 is a diagram of a principal portion of an apparatus for transmitting a particulate material from the conventional flexible container.
Figure 12:
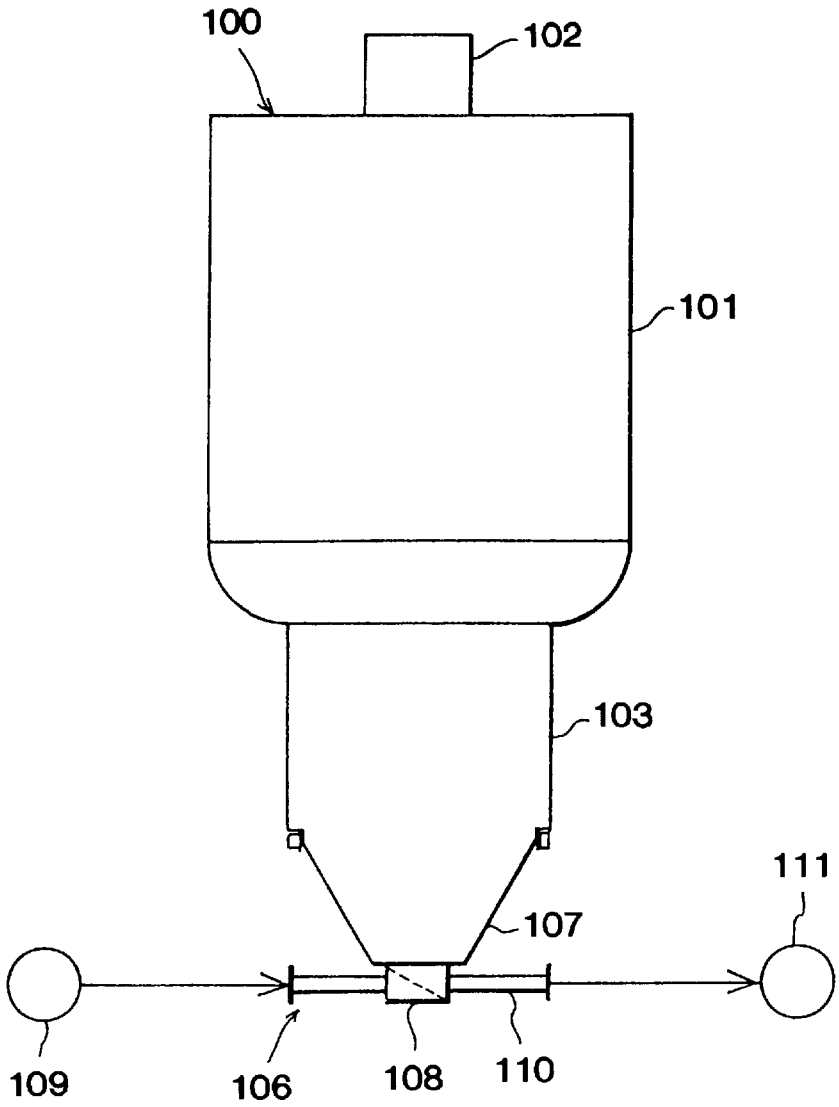
FIG. 12 PRIOR ART
FIG. 12 is a diagram of a principal portion of an apparatus for transmitting a particulate material from the conventional flexible container.

At a receiving end, in the same way as attaching the sleeve of a conventional flexible container to a receiving hopper, a distal end 84*c* of the sleeve 84 is fitted on a cylindrical connected portion 58 of a discharge unit 11*a* in another embodiment of this invention shown in FIG. 9. An outer periphery thereof is tightened with a metal band B3, thereby to connect the sleeve 84 and discharge unit 11*a* in an airtight condition. Subsequently, the string sealing the sleeve 84 is removed, whereby a supply pipe 18*d* and discharge pipe 19*a* communicate with the sleeve 84*c*.

The supply pipe 18*a* of this discharge unit 11*a* has a tapered distal end, with one half side thereof opened to defined a jet nozzle 18*c*.

The other aspects of construction, operation and effect of this flexible container, the method and apparatus for transmitting the particulate material from this flexible container, the discharge unit for the flexible container, are omitted to avoid repetition.

The foregoing relates to preferred exemplary embodiments of the invention, it being understood that other variants and embodiments thereof are possible within the spirit and scope of the invention, the latter being defined by the appended claims.

What is claimed is:

1. A flexible container comprising a main body, a sealable input opening in an upper portion of said main body, and a sleeve connected with and extending from a lower end of the main body, wherein said sleeve includes a connector formed at a distal end of said sleeve for connecting said sleeve in a sealed condition to a discharge unit of a particulate material transmitting apparatus, said sleeve being shaped such that at least the distal end and the connector are foldable on a side surface of the main body, said main body further including holding means for holding at least the distal end and the connector in a folded position on the side surface of the main body, with an end opening of said connector directed upward.

2. A method of transmitting a particulate material from a flexible container, the method comprising folding a sleeve of the flexible container on a side surface of a main body of said flexible container, and securing the sleeve to the side surface of said main body with an opening of a distal end directed upward, introducing the particulate material into said flexible container, lowering the sleeve from said main body and connecting said distal end of the sleeve of said flexible container to a combination container discharge unit including a fluid supply pipe (18) and a fluid discharge pipe (19) connected to a transmitting pipe (13), introducing a carrier fluid supplied from a fluid source via said fluid supply pipe into the distal end of the sleeve, increasing a fluidity of at least a portion of said particulate material in said container, discharging at least a part of said portion of said particulate material into the discharge pipe (19), and transmitting a portion of the particulate material in combination with said carrier fluid from the distal end of said sleeve of the flexible container to a predetermined destination by a particulate material-fluid transmitting apparatus.

3. A method as defined in claim 2, further comprising dividing the fluid supplied from said fluid source into a first portion of the fluid that is directed into said sleeve of the flexible container and a second portion of the fluid which is directed directly into said fluid discharge pipe of the discharge unit, and joining the second portion of fluid directed into said discharge pipe with a flow of said portion of the particulate material discharged into the discharge pipe from said flexible container, thereby causing the particulate material to flow more easily into the discharge pipe.

4. A method as defined in claim 3, further comprising adjusting a quantity of the second portion of the fluid to adjust the fluidity of the particulate material according to a transmission characteristic of the particulate matter.

5. A method as defined in claim 2, further comprising adding a carrier fluid which is additionally supplied to the discharge pipe (19) and the transmitting pipe (13).

6. A method as defined in claim 2, further comprising forcibly expanding and contracting the flexible container by varying internal pressure thereof immediately before completion of said transmitting in order to drop the particulate material adhering to inner surfaces of the flexible container toward the distal end.

7. A flexible container as set forth in claim 1, in which said discharge unit is connected to the connector of the sleeve, and includes a fluid source for supplying a carrier fluid through said discharge unit and through the sleeve into the flexible container, and a transmitting pipe connected with said discharge unit for transmitting said carrier fluid and a particulate material to a predetermined destination, the particulate material having a fluidity that is increased in the flexible container by the carrier fluid supplied from a fluid supply and dispensed by said discharge unit.

8. A flexible container as defined in claim 7, wherein the discharge unit has a connected portion for connection to the connector of the flexible container in a sealed condition, said connected portion having a connecting joint corresponding to a male joint of said connector.

9. A flexible container as defined in claim 8, wherein the male joint of said connector is connectable and separable by a one-touch quick operation.

10. A flexible container as defined in claim 7, further comprising means for additionally supplying the carrier fluid to the discharge unit and the transmitting pipe (13).

11. A flexible container as defined in claim 7, further comprising means for varying internal pressure of the flexible container to expand and contract the flexible container forcibly.

12. A flexible container as defined in claim 7, wherein the predetermined destination includes collecting means for separating the particulate material from the carrier fluid and collecting the particulate material, suction means for drawing the carrier fluid separate by the collecting means, an atmosphere communicating passage for communicating the carrier fluid to an atmosphere, and an atmosphere communicating valve for opening and closing said atmosphere communicating passage, wherein an internal pressure of the flexible container is varied by operation of said atmosphere communicating valve.

13. A flexible container as defined in claim 1, in which said discharge unit includes a connected portion for a sealed connection to the connector of the flexible container, a supply pipe connected with said connected portion for communicating a carrier fluid from a fluid source to an interior of the flexible container, and a discharge pipe for communicating the fluid from the interior of the flexible container to a fluid-particulate material transmitting pipe.

14. A flexible container as defined in claim 13, wherein the supply pipe and the discharge pipe are arranged coaxially one outside the other, the connected portion is formed at a distal end of said discharge pipe, a distal end of the supply pipe projects further into said connector than said connected portion, and a portion of the supply pipe projecting further into the connector than the connected portion defines jet openings for jetting the fluid into the flexible container.

15. A flexible container as defined in claim 14, wherein said jet openings are distributed in a peripheral surface of said supply pipe within a predetermined range axially of the supply pipe.

16. A flexible container as defined in claim 13, wherein a distal end of the connector formed at the sleeve is closed by an end element.

17. A flexible container as defined in claim 13, further comprising a bypass passage for communicating the carrier fluid from the supply pipe at a proximal end thereof to the discharge pipe.

18. A flexible container as defined in claim 17, further comprising a bypass valve for opening, closing, and adjusting an opening of the bypass passage.

19. A flexible container as defined in claim 13, further comprising means for forming a circulatory flow in the discharge pipe.

* * * * *